US006830089B1

(12) United States Patent
Tamai et al.

(10) Patent No.: US 6,830,089 B1
(45) Date of Patent: Dec. 14, 2004

(54) COAT FILM TRANSFER HEAD DEVICE AND COAT FILM TRANSFER TOOL

(75) Inventors: Shigeru Tamai, Ikeda (JP); Kouhei Koyama, Kyoto (JP); Masatoshi Shintani, Sanda (JP)

(73) Assignee: Seed Rubber Company Limited, Osaka (JP)

( * ) Notice: Subject to any disclaimer, the term of this patent is extended or adjusted under 35 U.S.C. 154(b) by 128 days.

(21) Appl. No.: 09/610,572

(22) Filed: Jul. 5, 2000

(30) Foreign Application Priority Data

Jul. 6, 1999 (JP) ..... 11-192409

(51) Int. Cl.[7] ..... B32B 31/00

(52) U.S. Cl. ..... 156/577; 156/579; 118/76; 118/257; 242/160.4; 242/171; 242/588.6

(58) Field of Search ..... 156/577, 574, 156/579, 523, 527, 540, 238; 118/200, 257, 76; 242/160.2, 171, 588.2, 588, 588.3, 588.6, 160.4, 170; 225/46

(56) References Cited

U.S. PATENT DOCUMENTS 3,804,055 A * 4/1974 Nishikawa et al. ..... 116/28.1
5,556,469 A * 9/1996 Koyama et al. ..... 118/257
5,904,806 A * 5/1999 Mendelovich et al. ..... 156/523

FOREIGN PATENT DOCUMENTS

DE 4324383 A1 * 1/1995 ..... B21D/43/05

* cited by examiner

*Primary Examiner*—Chris Fiorilla
*Assistant Examiner*—Cheryl N. Hawkins
(74) *Attorney, Agent, or Firm*—Rader, Fishman & Grauer PLLC

(57) ABSTRACT

A coat film transfer head device having a coat film transfer head held at a tape pressing and transferring position suited to the user's manner of holding a writing tool, and capable of checking the tape pressing and transferring position directly and visually. It comprises a head main body for pressing and transferring a coat film transfer tape, a head holder for supporting the head main body rotatably about its axial center, and a rotating operation unit for positioning the head main body in the rotating direction, and this rotating operation unit functions also as the head position indicating unit for indicating the tape pressing and transferring position of the head main body. Therefore, the user can check the tape pressing and transferring position directly and visually.

12 Claims, 24 Drawing Sheets

COAT FILM TRANSFER HEAD DEVICE AND COAT FILM TRANSFER TOOL

BACKGROUND OF THE INVENTION

1. Field of the Invention

The present invention relates to a coat film transfer head device and a coat film transfer tool, and more particularly to a coat film transfer head technique for pressing a coat film transfer tape onto the object of transfer, being disposed at the leading end portion of a coat film transfer tool for transferring correction paint layer, marker paint layer, adhesive layer or other coat film on a coat film transfer tape onto the sheet of paper or the like.

2. Description of the Related Art

The coat film transfer tool of this kind is disclosed, for example, in Japanese Patent Laid-open Publication No. 5-58097 and Japanese Utility Model Laid-open Publication No. 5-13800.

These coat film transfer tools are both used as an eraser for correcting wrong letters, and as shown in FIG. 24(*a*) and FIG. 24(*b*), a pay-off reel (c) on which a coat film transfer tape (b) is wound, and a take-up reel (d) for collecting the used coat film transfer tape (b') are rotatably provided in a case (a) which is held by one hand, and a coat film transfer head (f) for pressing the coat film transfer tape (b) onto the object of transfer (the correction area on the sheet of a paper) (e) is projecting from the leading end portion of the case (a). The both reels (c), (d) are automatically taken up as being linked mutually through an interlock unit (g) so as to cooperate. In the interlock unit (g), gears (h), (i) provided on the outer circumference of the both reels (c), (d) are engaged with each other.

The case (a) is a flat box having the contour shape and width dimension enough for incorporating the pay-off reel (c) and take-up reel (d), and the face and back of the flat shape, that is, the face and back to the sheet of paper in FIG. 24(*a*) and FIG. 24(*b*) are the gripping sides when held by hand during use.

In the coat film transfer tool in FIG. 24(*a*), the leading end pressing portion (j) of the head (f) is designed to guide the coat film transfer tape (b) in a winding state of the pay-off reel (c) and take-up reel (d), and it is a so-called vertical pulling structure suited to correction of a part of vertically written letters such as Japanese sentences. On the other hand, in the coat film transfer tool shown in FIG. 24(*b*), the leading end pressing portion (j) of the head (f) is designed to guide the coat film transfer tape (b) almost oppositely to the gripping sides of the case (a), and it is a so-called lateral pulling structure suited to correction of a part of laterally written letters alphabetic sentences.

When correcting wrong letters by these coat film transfer tools, the gripping sides of the case (a) are held by fingers, as shown in the drawing, the coat film transfer tape (b) is held tightly on the correction area (e) by means of the leading end pressing portion (j) of the head (f), and the case (a) is moved in a desired direction (arrow direction in FIG. 24(*a*), vertical direction to sheet of paper in FIG. 24(*b*)). As a result, the correction paint layer of the coat film transfer tape at the leading end pressing portion (j) of the head (f) is applied on the correction area (e) and the letter is erased, and the used coat film transfer tape (b') is automatically taken up and collected on the take-up reel (d).

In either structure, however, although it can be used like a writing tool in vertical pulling or lateral pulling use, it is difficult to use in the opposite directly.

Still more, the writing tool is held in different manners depending on the users, and in the structure assuming an ideal and uniform holding manner of writing tool, all users cannot hold like a writing tool.

SUMMARY OF THE INVENTION

It is hence a primary object of the invention to prevent a novel coat film transfer head device solving the problems of the prior art.

It is other object of the invention to present a coat film transfer head device which can be used like a writing tool by adjusting the tape pressing and transferring position depending on the manner of holding a writing tool by the user, concerning the coat film transfer head, and which can check the tape pressing and transferring position at this time directly and visually.

It is another object of the invention to present a coat film transfer tool having such coat film transfer head device.

The coat film transfer head device of the invention comprises a head main body for pressing and transferring the coat film transfer tape, a head holder for supporting the head main body rotatably about its axial center, and a rotating operation unit for positioning the head main body in the rotating direction, in which the rotating operation unit serves also as a head position indicating unit for indicating the tape pressing and transferring position of the head main body.

In a preferred embodiment, the rotating operation unit includes an operation lever related to the tape pressing and transferring position of the head main body, and this operation lever projects to the outside of the case through an operation guide in a slit form penetrating through the case of the coat film transfer tool. This operation guide in a slit form defines the operating range in the rotating direction of the operation level, and controls the tape pressing and transferring position of the head main body.

A first structure of the coat film transfer tool of the invention is a refill type coat film transfer tool capable of replacing the coat film transfer tape, that is, a tape cartridge containing a rotatable pay-off reel on which a coat film transfer tape is wound, and a rotatable take-up reel for collecting the used coat film transfer tape is detachably provided in a case which is held by one hand, and the coat film transfer head device is attached to the leading end portion of the tape cartridge.

A second structure of the coat film transfer tool of the invention is a disposable coat film transfer tool having a pay-off reel on which a coat film transfer tape is wound, and a take-up reel for collecting the used coat film transfer tape provided in a case which is held by one hand, and the coat film transfer head device is attached to the leading end portion of the case.

In the coat film transfer head device of the invention, the head main body for pressing and transferring the coat film transfer tape is rotatable about its axial center by the action of the head holder, and it can be used like a writing tool depending on the manner of holding a writing tool of each user.

That is, in the head main body, by manipulating the rotating operation unit, its position in the rotating direction can be selected and set property in a specified range, and an optimum tape pressing and transferring position is held depending on the application or manner of holding by the user. It also includes a concept that the coat film transfer tool of the invention, if originally designed for use by a right-handed user in the head basic structure, can be held and used by a left-handed user naturally in an optimum head position.

The rotating operation unit also functions as a head position indicating unit for indicating the tape pressing and transferring position of the head main body, so that the user can check the tape pressing and transferring position directly and visually.

These and other objects and features of the invention will be more clearly understood by reading the detailed description with the accompanying drawings and the novel facts indicated in the claims.

BRIEF DESCRIPTION OF THE DRAWINGS

FIG. 8(*b*) is a partial sectional side view for explaining the operation in rotating direction of the coat film transfer head of the eraser with the operation lever in a horizontal position.

FIG. 8(*c*) is a partial sectional side view for explaining the operation in rotating direction of the coat film transfer head of the eraser with an operation lever in a vertical upward position.

FIG. 11(*b*) is a front sectional view for explaining the assembling procedure of the pay-off reel side position with the rewind button engaged with the rotary drive unit.

FIG. 12(*b*) is a perspective view showing the lateral pulling use state by the right hand of the eraser to form curves while moving the coat film transfer tool generally in the left to right direction.

FIG. 14(*b*) is a perspective view showing the lateral pushing use state by the right hand of the eraser to form curves while moving the coat film transfer tool generally in the right to left direction.

FIG. 15(*b*) is a perspective view showing the lateral pushing use state by the left hand of the eraser to form curves while moving the coat film transfer tool generally in the right to left direction.

FIG. 16(*b*) is a side elevation view showing the structure of the modified coat film transfer head of the eraser in embodiment 2 of the invention.

FIG. 16(*c*) is a top planar view showing the structure of the modified coat film transfer head of the eraser in embodiment 2 of the invention with the operation lever shown in cross-section.

FIG. 17(*b*) is a side elevation view showing the structure of another modified coat film transfer head of the eraser in embodiment 3 of the invention.

FIG. 19(*b*) is a side view of the coat film transfer head.

FIG. 21(*b*) is a partial sectional side view showing the structure of the yet another coat film transfer head of the eraser in embodiment 6 of the invention with the operation lever in a vertical upward position.

FIG. 24(*b*) is a partially cut-away front view of internal structure of a conventional eraser in lateral pulling use structure.

DETAILED DESCRIPTION OF THE PREFERRED EMBODIMENTS

Figure 1:
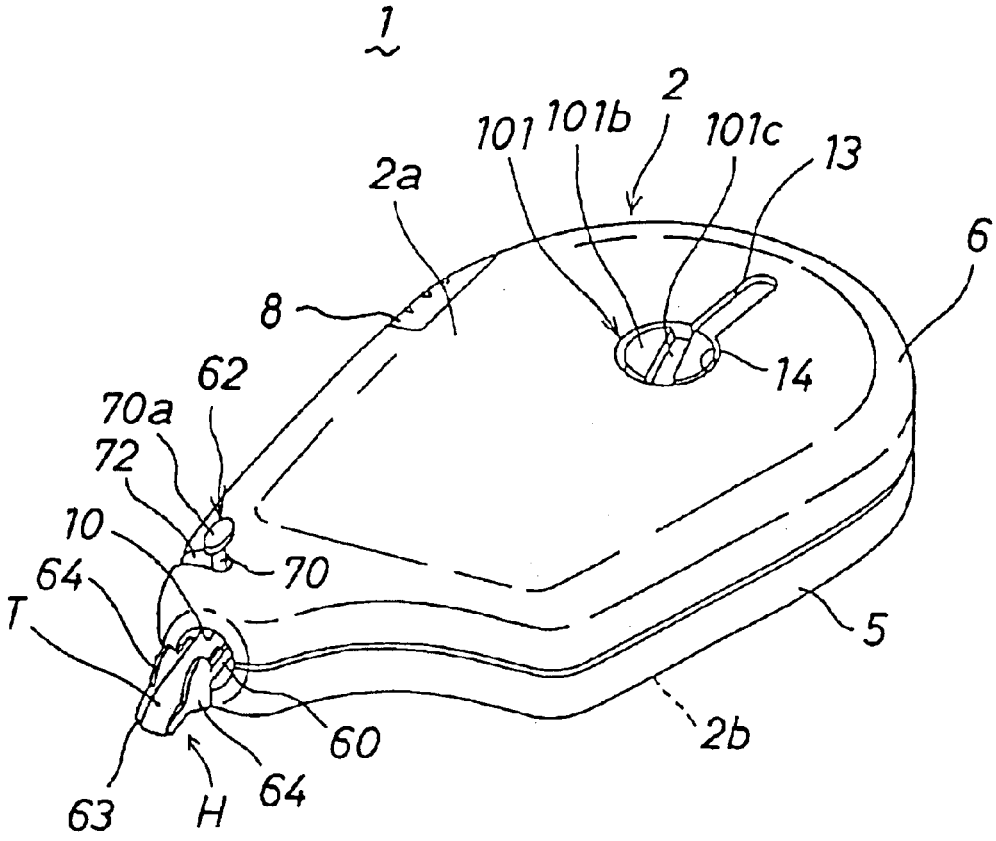
FIG. 1 is a perspective view showing an eraser in embodiment 1 of the invention.

Referring now to the drawings, preferred embodiments of the invention are described below.

FIG. 1 through FIG. 23 show the tape cartridge and coat film transfer tool of the invention, and same reference numerals given throughout the drawings indicate same structural members or elements.

Embodiment 1

A coat film transfer tool according to an embodiment of the invention is shown in FIG. 1 to FIG. 15(*b*). This coat film transfer tool 1 is specifically used as an eraser for correcting wrong letters, particularly relating to the cartridge type or refill type structure capable of replacing a coat film transfer tape T which is a consumable part.

Figure 3:
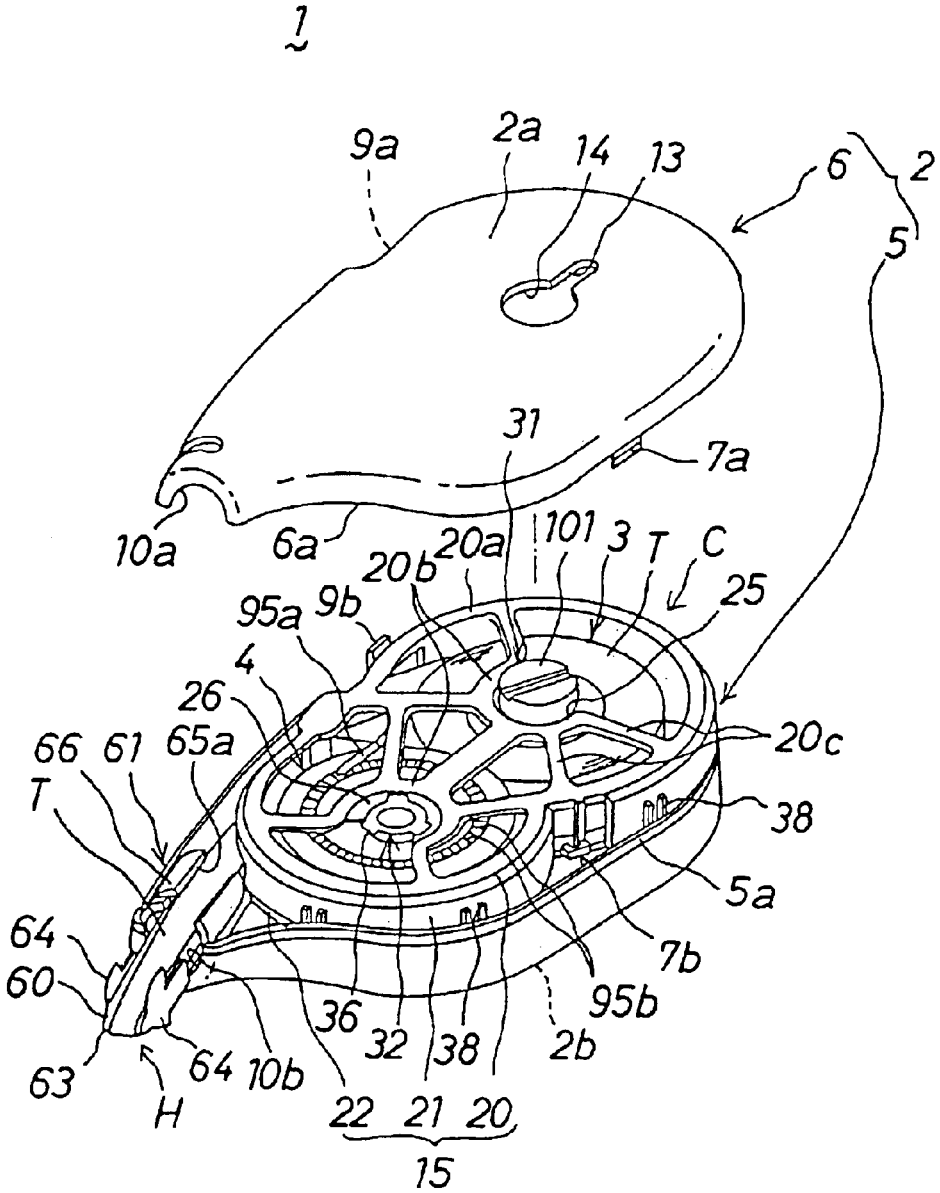
FIG. 3 is a perspective view of an open case state of the eraser.
Figure 4:
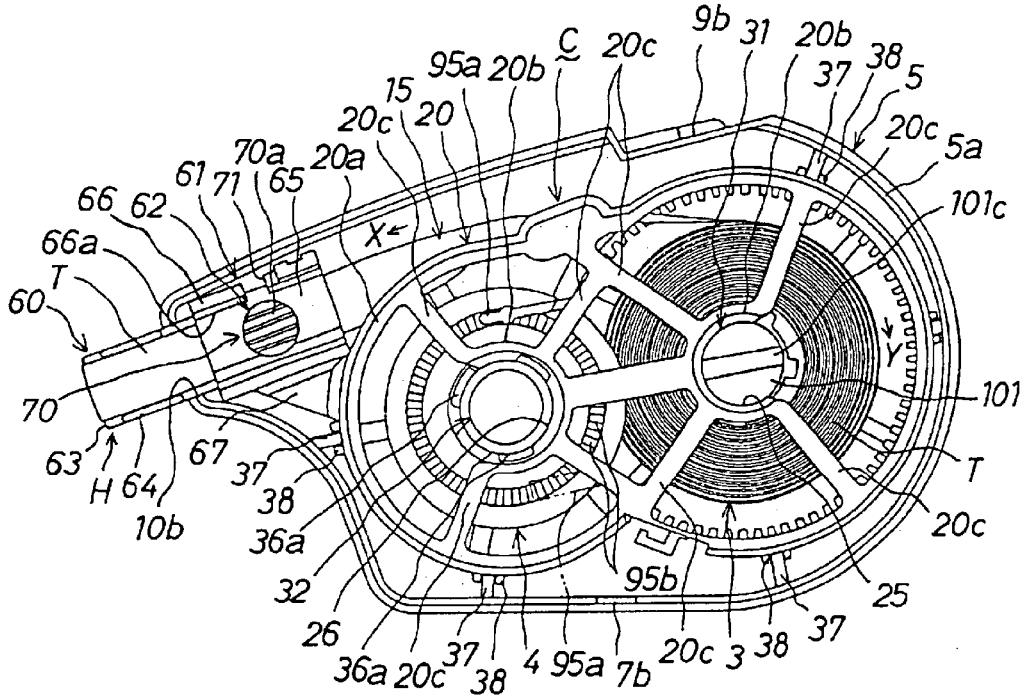
FIG. 4 is a front view showing the inside of the cases main body of the eraser.

The coat film transfer tool 1 includes a case 2 having an appearance and shape as shown in FIG. 1, in which, as shown in FIG. 3 and FIG. 4, a tape cartridge C having a coat film transfer head H and a tape interlock unit (interlock mechanism) D are disposed, and moreover a pay-off reel 3 and a take-up reel 4 are supported on the tape cartridge C. Each component is described below.

I. Case 2

The case 2 is, as shown in the drawing, a flat box having a front contour shape and width dimension enough to incorporate the tape interlock unit D, and, as mentioned below, its confronting pair of flat face and back surfaces 2*a*, 2*b* are standard gripping sides when held in hand during use.

The case 2 is a plastic structure molded integrally by injection molding or the like, consisting of a case main body 5 and a cap body 6 which can be separated from each other, and the tape cartridge C and tape interlock unit (interlock mechanism) D are mounted on the case main body 5.

Figure 5:
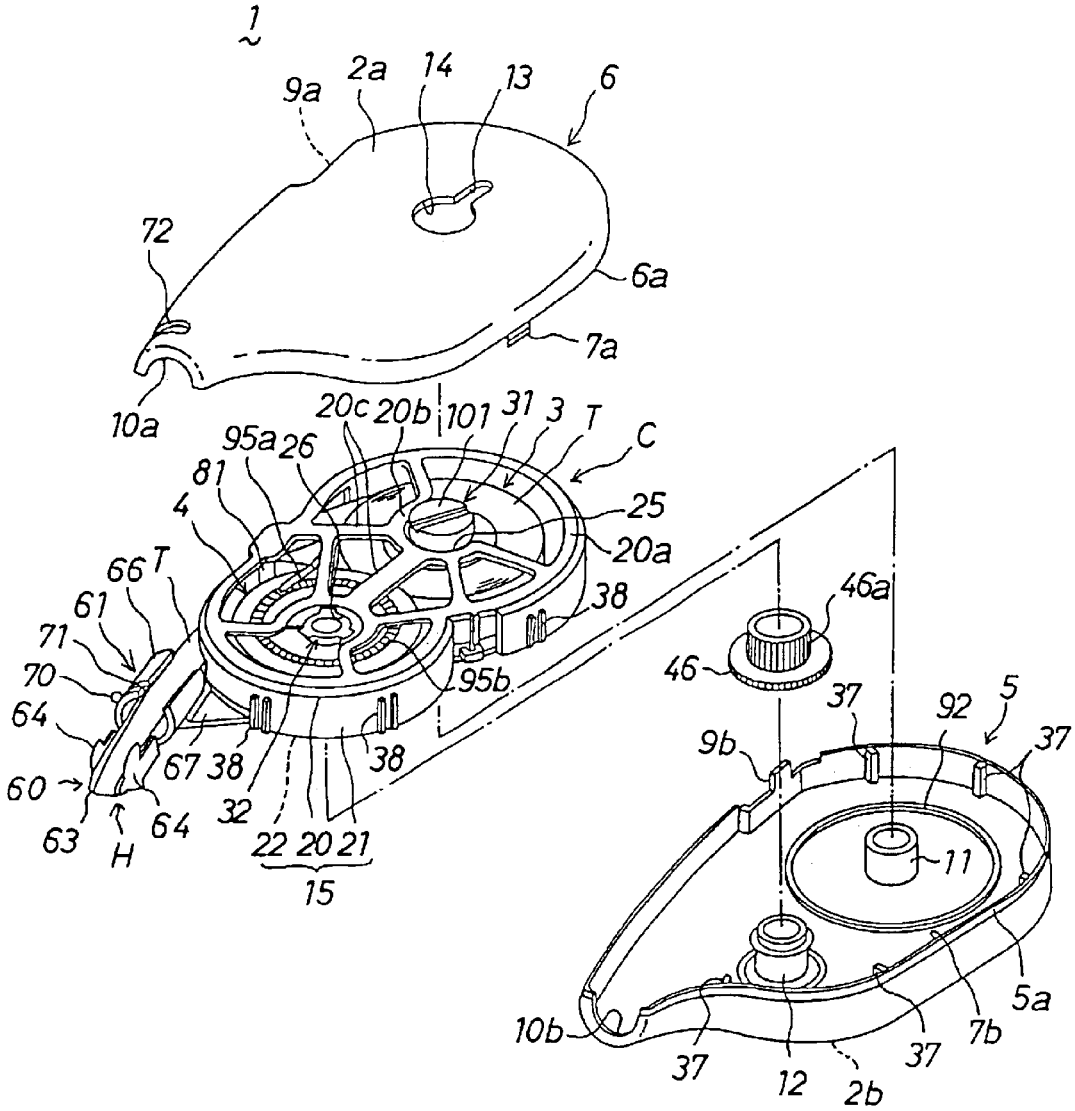
FIG. 5 is a perspective exploded view of the eraser.

The case main body 5 and cap body 6 are composed as shown in FIG. 3 and FIG. 5, in which an opening inner peripheral edge 6*a* of the cap body 6 is fitted to a fitting flange 5*a* provided on almost entire circumference of the opening inner peripheral edge of the case main body 5. At one side of the case main body 5 and opening of the cap body 6, separable engaging portions 7*a*, 7*b* are provided, and engaging portions 9*a*, 9*b* tightened together by a tightening cap 8 are provided at the opposite side.

At the leading end portions of the case main body 5 and cap body 6, inserting grooves 10*a*, 10*b* for forming head insertion parts 10 for inserting the coat film transfer head H inside out are formed by notching, and at the inside of the case main body 5, moreover, hollow rotary support shafts 11, 12 are integrally provided for rotating and supporting the pay-off reel 3 and take-up reel 4 of the tape cartridge C.

By assembling the cap body 6 into the case main body 5 by mutually positioning and fixing, the opening inner peripheral edge 6*a* of the cap body 6 is fitted into the fitting flange 5*a* of the case main body 5, and the engaging portions 7*a*, 7*b* and the engaging portions 9*a*, 9*b* are engaged with each other. By sliding the tightening cap 8 to cover the engaging portions 9*a*, 9*b*, the both 9*a*, 9*b* are tightened to each other, and the case 2 is closed.

On the other hand, by the reverse manipulation, the case 2 is separated from the case main body 5 and cap body 6, and is opened. In this closing process of the case 2, the circular head insertion part 10 is opened and formed at the leading end portion, and through this head insertion part 10, the coat film transfer head H projects outside from the leading end portion of the case 2 and is positioned.

In the cap body 6, moreover, a remainder check window 13 for checking the remainder of the coat film transfer tape T and an opening 14 for a rewind button 101 mentioned below are continuously opened.

II. Tape cartridge C

The tape cartridge C is a replaceable part as a consumable part, and its specific structure is shown in FIG. 2 to FIG. 11(*b*).

The tape cartridge C has a support main body 15, on which a pay-off reel 3 winding a coat film transfer tape T and a rotatable take-up reel 4 for collecting the used coat film transfer tape T' are rotatably mounted, and a coat film transfer head H for pressing the coat film transfer tape T onto the object of transfer is mounted rotatably about the axial center of the head. The tape cartridge C is mounted detachably on the case main body 5 as shown in FIG. 2 to FIG. 5.

The support main body 15 is, specifically, a synthetic resin structure formed as a cartridge case for accommodating the both reels 3, 4, and comprises a support base plate 20, a protective wall 21, and a protective plate 22. The support base plate 20 and protective wall 21 are formed in one body by injection molding or the like, and compose the principal parts of the support main body 15.

The support base plate 20 rotatably supports the both reels 3, 4, and its shape and dimension are set as thin and compact as possible within a range of assuring the holding function of the reels 3, 4.

Specifically, the support base plate 20 has a flat plate skeletal structure having an outer contour corresponding to the inner contour of the case 2.

The skeletal structure of the support base plate 20 comprises an outer contour skeletal member 20*a* for forming the outer contour of the support base plate 20, a pair of bearing skeletal members 20*b*, 20*b* for forming bearings 25, 26 for rotating and supporting the both reels 3, 4, and a plurality of connection skeletal members 20*c*, 20*c*, . . . for connecting the outer contour skeletal member 20*a* and bearing skeletal members 20*b*, 20*b*, which are connected together to form a flat plate skeleton.

The outer contour skeletal member 20*a* has an outer contour corresponding to the inner contour of the case 2 as mentioned above, and composes a connection part with the protective wall 21 mentioned below. The bearing skeletal members 20*b*, 20*b* form, as shown in the drawing, bearings 25, 26 in a flat arc shape opened in part. The connection skeletal members 20*c* are formed as being extended in the radial direction about the pair of bearings 25, 26.

By such skeletal layout structure, while maintaining the specified holding strength, a lightweight compact structure is realized by using materials as little as possible. In particular, by disposing the connection skeletal members 20*c*, 20*c*, . . . radially, a uniform strength is assured in the entire support base plate 20, and a lightweight compact structure is realized.

The both bearings 25, 26 designed to support rotatably the upper side ends of rotary shafts 31, 32 of the both reels 3 and 4, that is, the ends 31*a*, 32*a* at the opposite side of the side of the case main body 5 supported by the rotary support shafts 11, 12.

In a specific rotary support structure of the both reels 3, 4 in the bearings 25, 26, engaging portions 35, 36 are provided in the upper side ends 31*a*, 32*a* of the rotary shafts 31, 32 of the reels 3, 4, and these engaging portions 35, 36 are rotatably engaged with the inner support portions of the bearings 25, 26.

Figure 6:
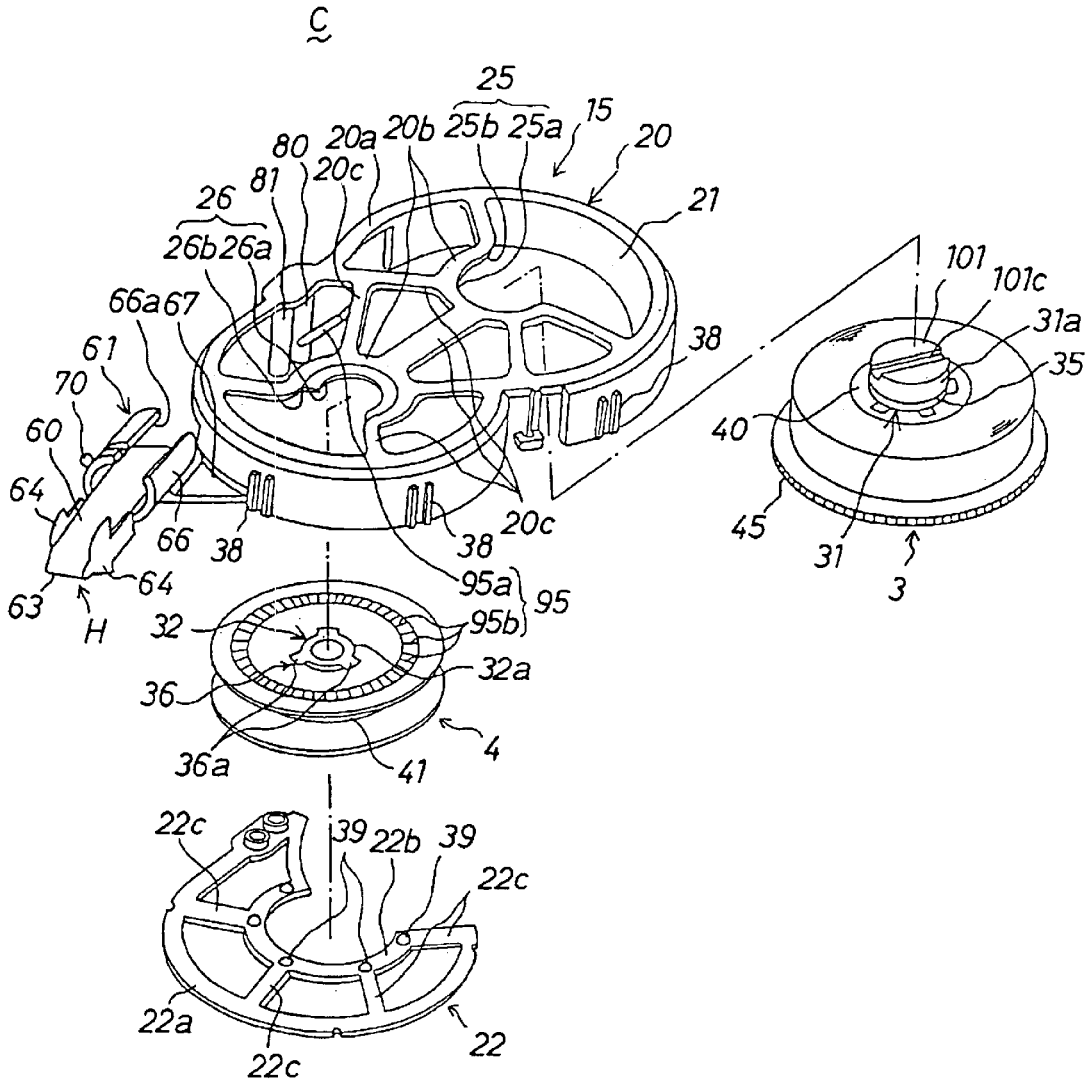
FIG. 6 is a perspective exploded view of a tape cartridge of the eraser.

In the illustrated embodiment, the bearings 25, 26 are in a form of bearings having outward openings opposite to each other as shown in FIG. 6. The flat shape of the bearings 25, 26 is designed in consideration of ease of assembling at the manufacturing site.

That is, the bearings 25, 26 are composed of circular parts 25*a*, 26*a* having an inner diameter corresponding to the outer diameter of the engaging portions 35, 36, and mounting insertion parts 25*b*, 26*b* spreading in a taper outward from the circular parts 25*a*, 26*a*.

The circular parts 25*a*, 26*a* of the bearings 21, 22 are disposed corresponding to the rotary support shafts 11, 12 of the case main body 5, respectively. Accordingly, in the configuration of the both reels 3, 4 on the support base plate 20, as shown in FIG. 4 and FIG. 5, the rotary shafts 31, 32 are set so as to be positioned coaxially to the rotary support shafts 11, 12, respectively.

On the other hand, the engaging portion 35 of the rotary shaft 31 of the pay-off reel 3 is an annular engaging groove formed in the entire circumference, and the engaging portion 36 of the rotary shaft 32 of the take-up reel 4 consists of a plurality of (three in this case) engaging pawls 36*a*, 36*a*, 36*a* formed at equal intervals in the circumferential direction.

As the engaging portions 35, 36 of the rotary shafts 31, 32 of the both reels 3, 4 are pressed and inserted by force from the mounting insertion parts 25*b*, 26*b* into the circular parts 25*a*, 26*a*, the boundary parts of the mounting insertion parts 25*b*, 26*b* and the circular parts 25*a*, 26*a* are expanded elastically, and are returned elastically, and the engaging portions 35, 36 are rotatably and slidably engaged and supported with the circular parts 25*a*, 26*a*, so that the both reels 3, 4 are positioned and supported at specified positions.

The protective wall 21 formed integrally with the support base plate 20 is provided in a standing form (that is, downward drooping form) from the outer peripheral edge of the support base plate 20, that is, the outer contour skeletal member 20*a*, and cooperates with the support base plate 20 to form the cartridge case for surrounding and accommodating the lower side of the both reels 3, 4, that is, three sides except the mounting side to the case main body 5.

This protective wall 21 is curved and formed so as to surround the outer circumference of the both reels 3, 4 along the outer contour shape of the support base plate 20, and surrounds and protects the outer circumference of the both reels 3, 4, and also reinforces the strength of the support base plate 20. Therefore, when assembling, handling and using the tape cartridge C, unexpected dislocation of the coat film transfer tape T from the pay-off reel 3 is prevented, and when handling the tape cartridge C, the coat film of the outermost surface of the coat film transfer tape T is covered and protected.

Hence, the relative shape and dimensions of the protective wall 21 and the reels 3, 4 are set so as to achieve this object and to prevent effectively dislocation of the both reels 3, 4 from the bearings 25, 26.

The protective wall 21 also functions as the positioning means for determining the support main body 15 on the case main body 5. For this purpose, the outer circumference 21*a* of the protective wall 21 has engaging portions 38, 38, . . . to be engaged with positioning engaging portions 37, 37, . . . provided in the inner circumference of the case 2. The engaging relation of these positioning engaging portion 37 and engaging portions 38 is determined in a structure detachable in the vertical direction and positioned in the lateral direction, that is, the horizontal direction.

In the state of the tape cartridge C being installed in the case main body 5, by positioning and engaging of the engaging portions 37, 38, 37, 38, . . . , the both reels 3, 4 are rotatably supported at both sides by the rotary support shafts 11, 12 of the main body case 5 and the support base plate 20 through the protective wall 21.

The protective plate 22 covers and protects the opposite side of the take-up reel 4 rotatably supported on the support base plate 20, and is provided at the open side edge of the protective wall 21. This protective plate 22 has a flat plate skeletal structure parallel to the support base plate 20, and its specific structure is designed to realize a lightweight compact structure by using materials as little as possible, while maintaining the specified strength, same as the support base plate 20.

That is, the protective plate 22 comprises, as shown in FIG. 6, an outer contour skeletal member 22*a* having a flat arc shape corresponding to the protective wall 21, an inner contour skeletal member 22*b* having the diameter corresponding to the lower side of the take-up reel 4, and radial connection skeletal members 22*c*, 22*c*, . . . for connecting the both 22*a*, 22*b*, which are connected in a skeletal structure.

At the inner side of the inner contour skeletal member 22*b* of the protective plate 22, that is, at the upper side, supports 39, 39, . . . for slidably and rotatably supporting the lower side of the take-up reel 4 are provided in an annular form. By contrast, although not shown, at the lower side of the take-up reel 4, supports 39, 39, . . . are provided concentrically about the annular grooves to be engaged slidably and rotatably.

The pay-off reel 3 has a hollow cylindrical tape core 40 winding a new coat film transfer tape T, and also includes a clutch mechanism 50 interlocked with the tape core 40 and a pay-off rotary gear 45 of the tape interlock unit D. The specific mounting structure of the pay-off reel 3 is described later in relation to a clutch mechanism 50.

The take-up reel 4 is to take up and collect the used coat film transfer tape T', and the leading end portion of the coat film transfer tape T is connected to the outer circumference of the hollow cylindrical tape core 41.

The tape core 41 serves also as part of the rotary shaft 32 of the take-up reel 4, and its axial upper end is integrally formed coaxially with the upper end 32*a* mentioned above, and this upper end 32*a* is rotatably supported on the support base plate 20. On the other hand, in the center of the tape core 41 (32), there is a fitting hole 41*a* having a tooth profile engaging portion of serration or spline, and it is integrally engaged with a rotary shaft 46*a* of a take-up rotary gear 46 of the tape interlock unit D mentioned below, detachably and integrally in the rotating direction.

The coat film transfer tape T is, for example, a plastic tape of polyester or acetate, or film base material of paper tape or the like (about 25 to 38 $\mu$m in thickness), having one side coated with a parting layer of vinyl chloride-vinyl acetate copolymer resin, low molecular polyethylene or the like, with an overlaying white correction paint layer, and further with a pressure-adhesive polyurethane or other adhesive agent (pressure-sensitive adhesive) in a laminate structure (specific structure not shown). The correction paint layer is of so-called dry type allowing to write on immediately after transfer.

The coat film transfer head H is to press the coat film transfer tape T onto the correction area (transfer area) such as wrong letters on the sheet of paper, and has a function of guiding the coat film transfer tape T and a function of pressing. The coat film transfer head H is provided on the support main body 15, and its base end support unit is held on the support main body 15 rotatably about the head axial center. More specifically, the coat film transfer head H has a head main body 60, a head holder 61, and a rotating operation unit 62.

The head main body 60 is to press and transfer the coat film transfer tape T, and specifically it is a rectangular plate having a certain elasticity, and a supported portion 65 is integrally formed at the base end side position.

The head main body 60 in the illustrated embodiment is a thin plate slightly wider than the coat film transfer tape T, and has a taper section so as to be thinner gradually toward the leading end, and its flat both sides form the tape running sides, and the leading end 63 is the leading end pressing portion for pressing the coat film transfer tape T. At both side edges of the head main body 60, there are guide flanges 64, 64 for guiding the running motion of the coat film transfer tape T.

The head holder 61 is to support the head main body 60 rotatably about its axial center, and comprises the supported portion 65 and a bearing 66 provided in the support main body 15 at the device main body side.

Figure 7:
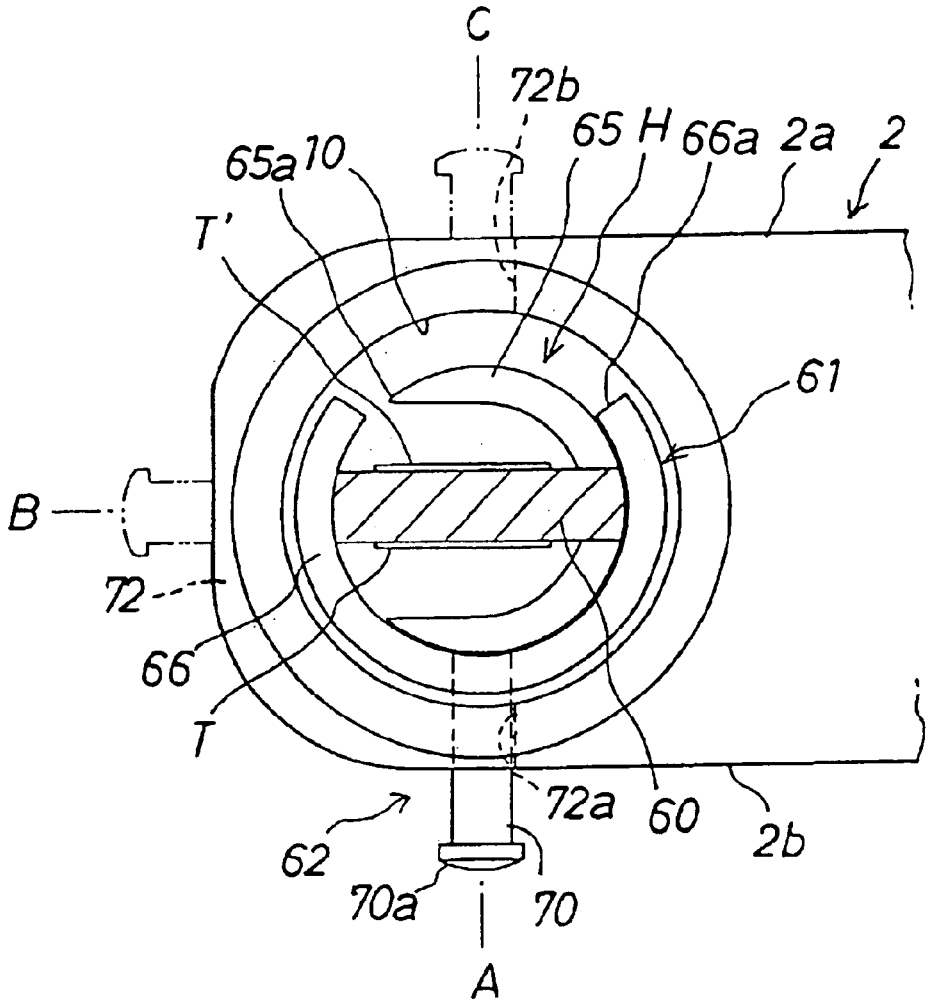
FIG. 7 is a magnified side view of a partial section of rotary structure of a coat film transfer head of the eraser.
Figure 8:
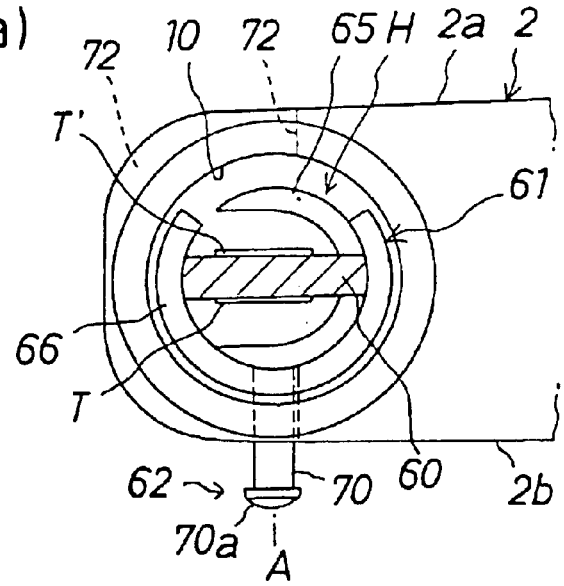
FIG. 8(*a*) is a partial sectional side view for explaining the operation in rotating direction of the coat film transfer head of the eraser with an operation lever in a vertical downward position.
Figure 8:
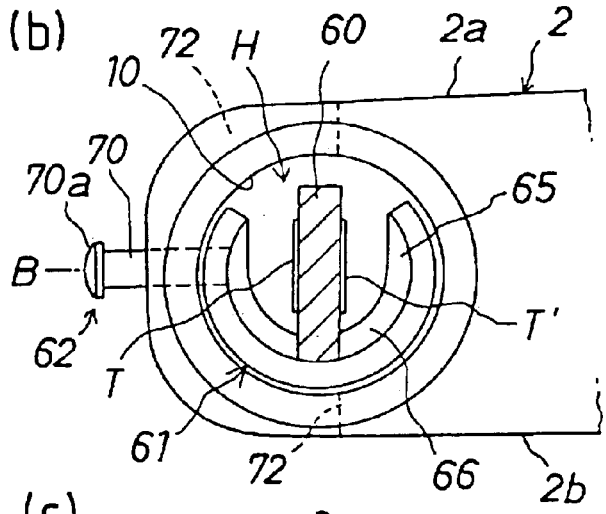
Figure 8:
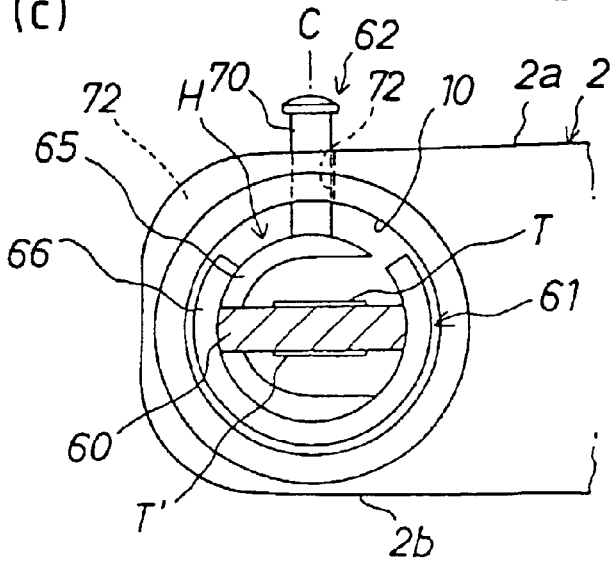

The supported portion 65 is a cylindrical piece provided concentrically and integrally with the head main body 60 as shown in FIG. 6 to FIG. 8(*c*), and more specifically a part thereof is formed in a section arc form having a setting opening 65*a* of the coat film transfer tape T to the head main body 60.

The bearing 66 is integrally provided at the leading end of the support main body 15 on the outer circumference of the protective wall 21 through the support unit 67. This bearing 66 is a tubular structure having an inner circumference corresponding to the outer circumference of the supported portion 65 as shown in FIG. 6 to FIG. 8(*c*), and, same as the supported portion 65, a part thereof is formed in a section arc form having a setting opening 66*a* of the coat film transfer tape T to the head main body 60. The supported portion 65 is slidably and rotatably supported on the bearing 66, and the head main body 60 is freely rotatably about the axial center, in a specified rotating angle range mentioned below.

The rotating operation unit 62 is to operate in order to determine the position of the head main body 60 in the rotating direction, and functions also as the head position indicating part for indicating the tape pressing and transferring position of the head main body 60.

The rotating operation unit 62 is a columnar bar, and has an operation lever 70 having an operation knob 70*a* at its leading end as a principal part. This operation lever 70 is integrally formed near the leading end of the supported portion 65, and is extended linearly outward in the radial direction from the axial center of the supported portion 65. Relating to this, at the axial direction corresponding position of the bearing 66, a slit-form insertion part 71 is provided, and similarly at the corresponding position of the case 2, a slit-form operation guide 72 is opened.

The operation lever 70 projects to outside of the case 2, through the insertion part 71 and operation guide 72. In this case, the insertion part 71 of the bearing 66 functions as locking piece for preventing the head main body 60 from slipping out in the axial direction.

The rotating direction disposing position of the operation lever 70 corresponding to the head main body 15 is set in relation to the tape pressing and transferring position of the head main body 15, and the inserting part 71 and operation guide 72 are extended in the peripheral direction so as to allow move of the operation lever 70 in the rotating direction of the head main body 15. In particular, the operation guide 72 of the case 2 defines the rotating direction operating range of the operation lever 70, and controls the tape pressing and transferring position of the head main body 60.

The relation between the operation lever 70 and the tape pressing and transferring position of the head main body 15 is explained below in relation to the operation guide 72 (see FIG. 7, FIGS. 8(*a*)–8(*c*), FIG. 12(*a*) to FIG. 15(*b*)).

The composition of the operation guide 72 as the rotating direction operation range defining unit is determined as follows by reference to FIG. 7.

(a) When the operation lever 70 is in a state engaged with one end 72*a* of the operation guide 72, that is, at a vertical downward position (first defining position A shown in FIG. 8(*a*)), the head main body 60 of the coat film transfer head H is at an angle position for guiding, with the leading end pressing part 63 setting the coat film transfer tape T almost opposite to the gripping sides 2*a*, 2*b* of the case 2, so that the face and back surfaces of the coat film transfer tape T may be almost in the same direction as (parallel to) the gripping sides 2*a*, 2*b*.

Figure 12:
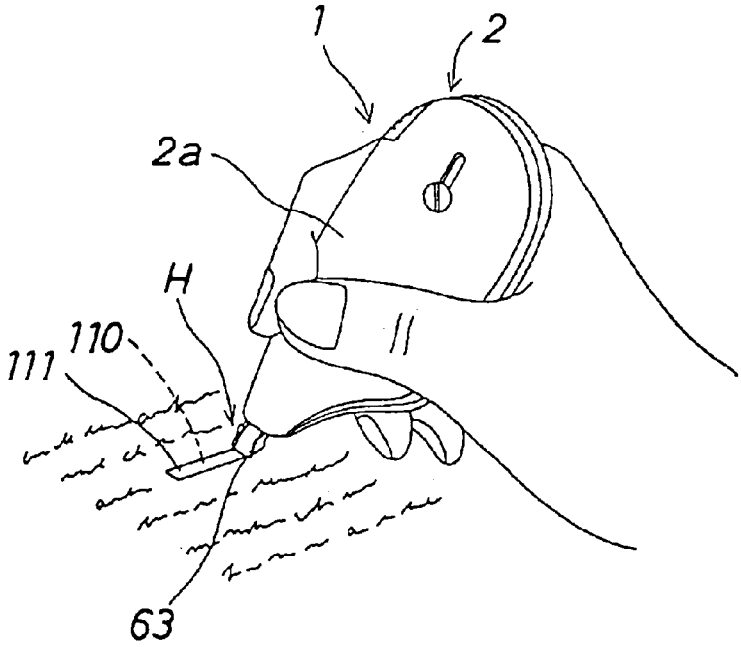
FIG. 12(*a*) is a perspective view showing the lateral pulling use state by a right hand of the eraser to form a straight line while moving the coat film transfer tool in a left to right direction.
Figure 12:
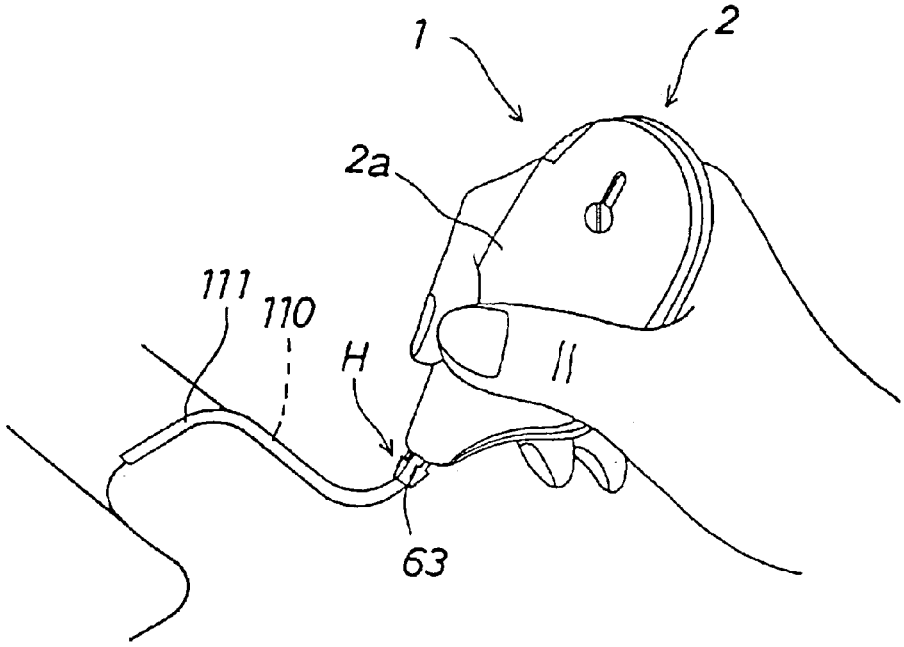

In this case, the new coat film transfer tape T forwarded from the pay-off reel 3 is at the lower side of the head main body 60, and it is in a state for lateral pulling use suited to a right-handed user for correcting a part of, for example, alphabetic writing (see FIGS. 12(*a*)–12(*b*)).

(b) When the operation lever 70 is at an intermediate position between the both ends 72*a*, 72*b* of the operation guide 72, that is, at a horizontal position (second defining position B shown in FIG. 8(*b*)), the head main body 60 of the coat film transfer head H is at an angle position for guiding, with the leading end pressing part 63 setting the coat film transfer tape T remaining at the winding position of the payoff reel 3 and take-up reel 4, so that the face and back surfaces of the coat film transfer tape T may be almost in the vertical direction to (orthogonal to) the gripping sides 2*a*, 2*b*.

Figure 13:
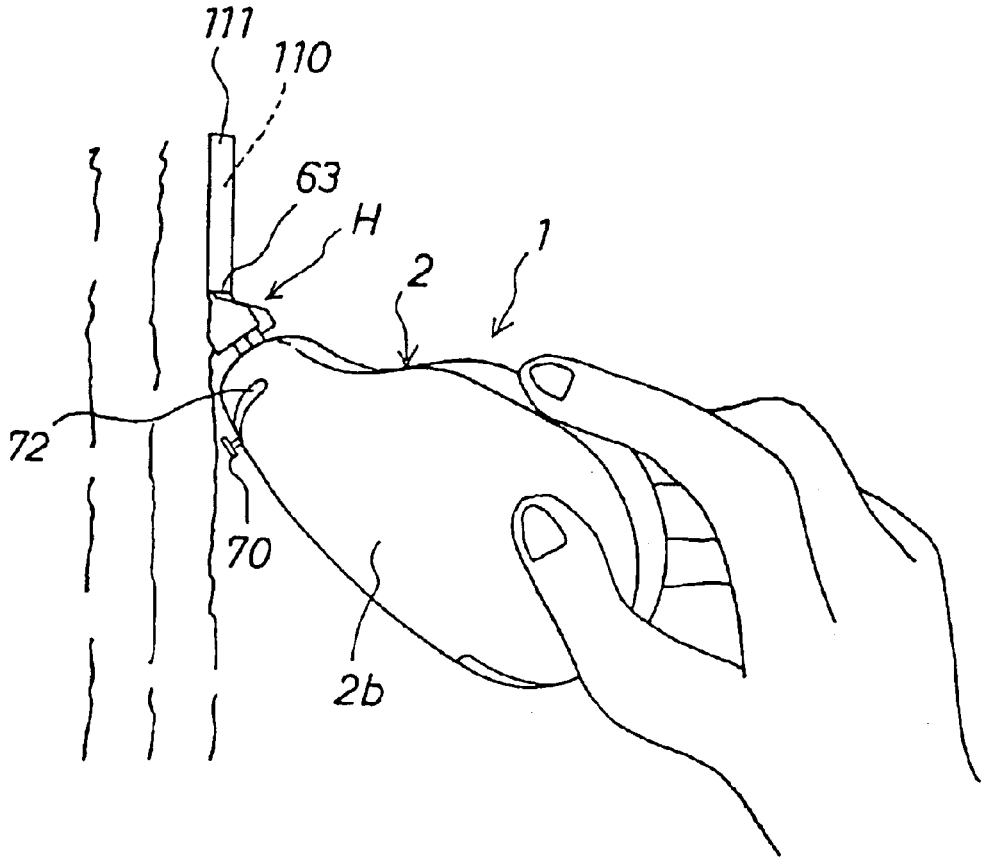
FIG. 13 is a perspective view showing the vertical pulling use state by right hand of the eraser.

In this case, the new coat film transfer tape T forwarded from the pay-off reel 3 is at left lower side of the head main body 60, and it is in a state for vertical pulling use suited for correcting a part of, for example, Japanese writing (see FIG. 13).

(c) When the operation lever 70 is engaged with other end 72*b* of the operation guide 72, that is, at a vertical upward position (third defining position C shown in FIG. 8(*c*)), the head main body 60 of the coat film transfer head H is at an angle position for guiding, with the leading end pressing part 63 setting the coat film transfer tape T almost oppositely to the gripping sides 2*a*, 2*b* of the case 2 in a state upside down of the case (a) above.

Figure 14A:
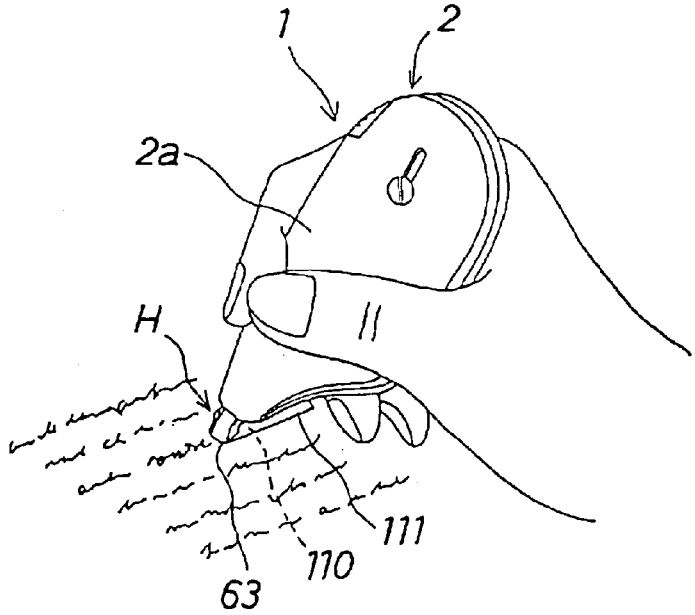
FIG. 14(*a*) is a perspective view showing the lateral pushing use state by the right hand of the eraser to form a straight line while moving the coat film transfer tool in a right to left direction.
Figure 14B:
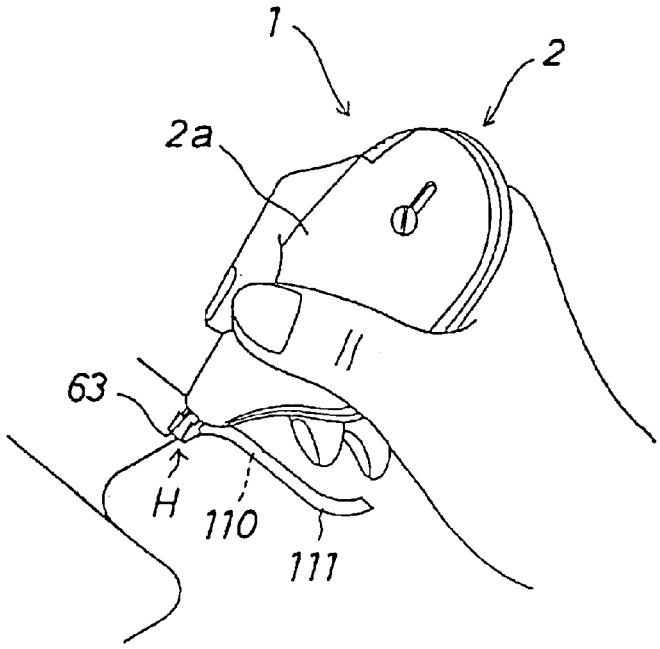
Figure 15A:
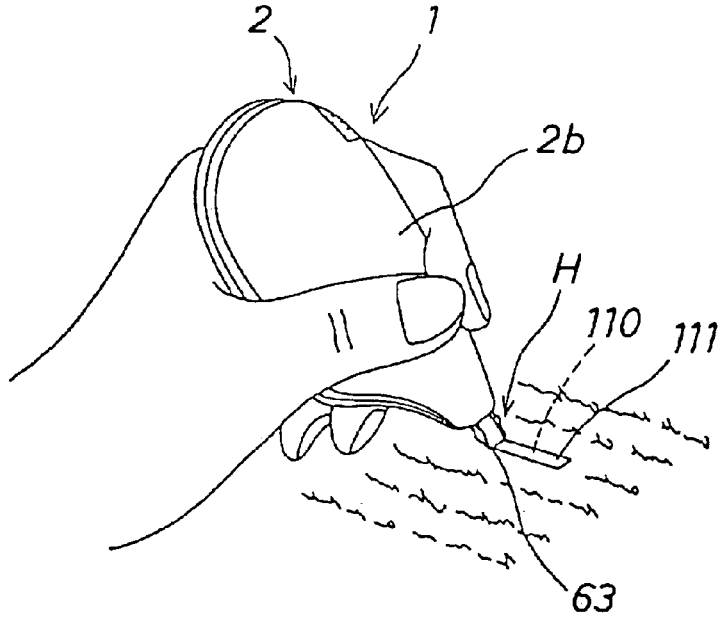
FIG. 15(*a*) is a perspective view showing the lateral pulling use state by a left hand of the eraser to form a straight line while moving the coat film transfer tool in the right to left direction.
Figure 15B:
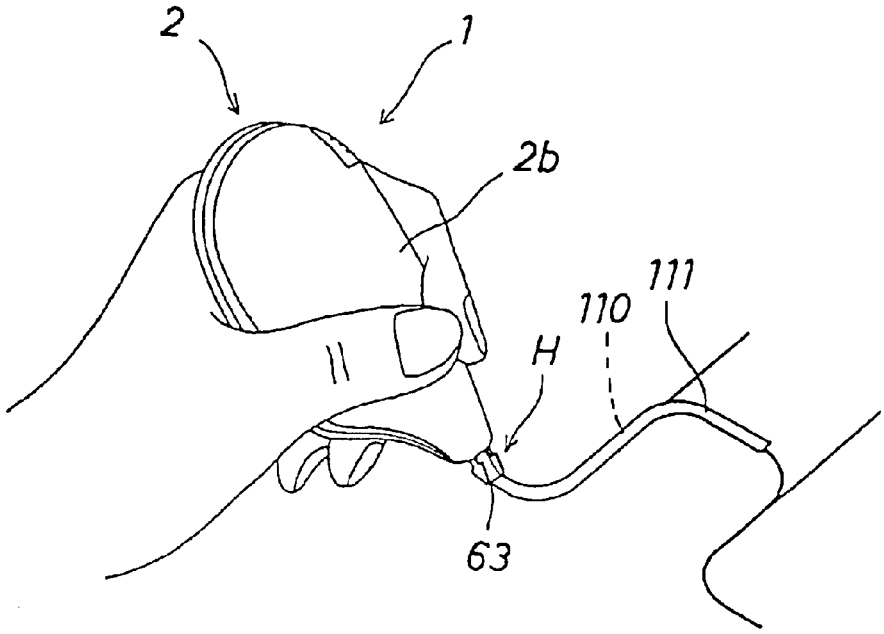

In this case, the new coat film transfer tape T forwarded from the pay-off reel 3 is at upper side of the head main body 60, and it is in a state for lateral pushing use suited to a right-handed user for correcting a part of, for example, alphabetic writing (see FIGS. 14(*a*)–14(*b*)), or in a state for lateral pulling use suited to a left-handed user for correcting a part of, for example, alphabetic writing (see FIGS. 15(*a*)–15(*b*)).

The rotating operation unit 62 is for positioning the head main body 60 in the rotating direction, and it also functions as head position indicating unit for indicating the tape pressing and transferring position of the head main body 60.

As clear from the description herein, the direction of the operation lever 70 indicates directly and visually the opposite direction of the new coat film transfer tape T (functioning as head position indicating unit), and the user can check the tape pressing and transferring position of the head main body 60 by referring to the direction of this operation lever 70.

The rotating direction operating range of the operation guide 72 (almost 180° at maximum in the shown example) can be set in various values from a small angle range to a large angle range, in consideration of the relation with the operation lever 70 and tape pressing and transferring position of the head main body 15.

The coat film transfer tape T forwarded from the pay-off reel 3 is guided into the leading pressing portion 63 along the one-side tape running surface of the coat film transfer head H, and is inverted through the leading end pressing portion 63, and is further guided along the opposite-side tape running surface to be taken up on the take-up reel 4.

In this case, as mentioned above, the leading head pressing portion 63 of the coat film transfer head H cooperates with the tape running surface of the head side, and guides the coat film transfer tape T in various running positions as mentioned above.

Concerning the configuration of the coat film transfer head H and both reels 3, 4, a pair of guide pins 80, 81 are provided between the both reels 3, 4 of the support main body 15 and the coat film transfer head H, and these guide pins 80, 81 function as the tape position changing means for changing the running position of the coat film transfer tape T.

One guide pin 80 is for changing the position of the coat film transfer tape T forward from the pay-off reel 3 to guide into the coat film transfer head H, and is formed in an upright position integrally at a proper position of the support main body 15 between the pay-off reel 3 and the coat film transfer head H. Other guide pin 81 is for changing the position of the used coat film transfer tape T' from the coat film transfer head H to guide into the take-up reel 4, and it is formed in an upright position integrally at a proper position between the coat film transfer head H and take-up reel 4.

In such structure having the both guide pins 80, 81 provided in the support main body 15, setting of the tape T is all complete in the product stage, and a general use has only to replace the tape cartridge C.

Further, on the take-up side guide pin 81, a guide roller (not shown) is rotatably supported. In such structure, smooth and neat take-up guide of the coat film transfer tape T', is promoted, and if a part of the coat film is left over due to transfer failure on the coat film transfer tape T', the inconvenience of the coat film transfer tape T' being wound around the guide pin 81 can be securely prevented. A similar guide roller may be also provided in the pay-off side guide pin 80.

III. Tape interlock unit D

The tape interlock unit (interlock mechanism) D is for mutually interlocking the pay-off reel 3 and take-up reel 4, and more specifically it is composed of a pay-off rotary gear (interlock gear) 45 provided at the pay-off reel 3 side, and a take-up rotary gear (interlock gear) 46 provided at the take-up reel 4 side.

Figure 2:
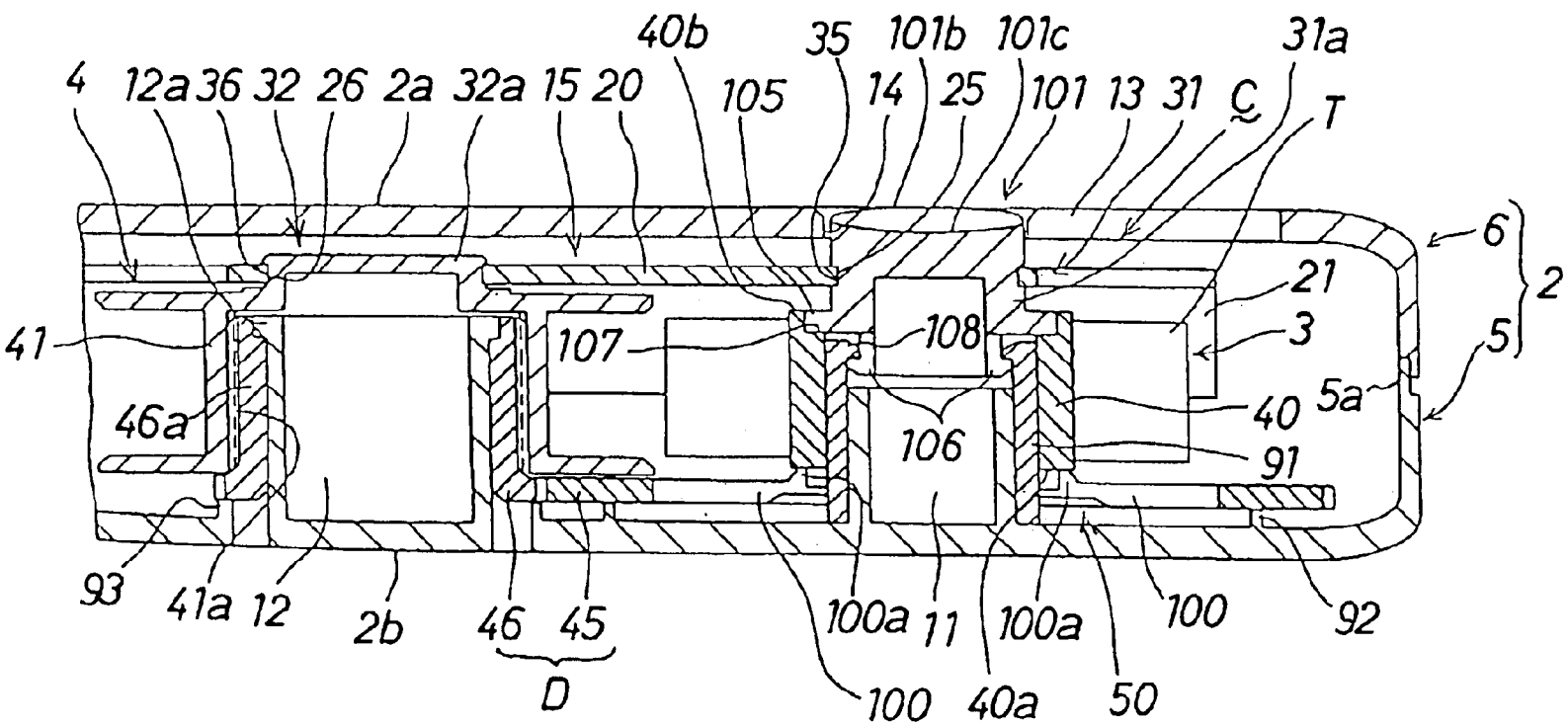
FIG. 2 is a side sectional view showing principal parts of the eraser.

The pay-off rotary gear 45 is formed integrally with a rotary drive unit 91 of the clutch mechanism 50 provided in the pay-off reel 3, and the rotary drive unit 91 functions also as rotary shaft of the pay-off rotary gear 45. The rotary drive unit 91 is a hollow cylinder, and is supported detachably and rotatably on the rotary support shaft 11 of the case main body 5. In this case, the axial lower end of the rotary drive unit 91 is slidably supported on the inner side of the case main body 5 as shown in FIG. 2. Reference numeral 92 is an annular rib provided at the inner side of the case main body 5, and this annular rib 92 is disposed corresponding to the outer circumference of the pay-off rotary gear 45 concentrically with the rotary support shaft 11, and slidably supports the lower side of the pay-off rotary gear 45, thereby preventing excessive distortion of the pay-off rotary gear 45.

On the outer circumference of the rotary shaft 91, the tape core 40 of the payoff reel 3 is supported coaxially and rotatably, and the tape core 40 and pay-off rotary gear 45 are frictionally engaged with each other through engaging protrusions 100, 100, . . . which are frictional engaging members of the clutch mechanism 50 described later.

The take-up rotary gear 46 is rotatably supported on the rotary support shaft 12 of the case main body 5 for supporting the take-up reel 4, and is engaged with the pay-off rotary gear 45 formed in a unit together with the pay-off reel 3 in the support main body 15. At the leading end of the rotary support shaft 12, a locking piece 12*a* is provided for preventing the take-up rotary gear 46 from slipping out.

Further, at the inner side of the case main body 5, an annular rib 93 is provided concentrically to the rotary support shaft 12 and corresponding to the take-up rotary gear 46, and the take-up rotary gear 46 is slidably and rotatably supported on this annular rib 93.

The take-up rotary gear 46 is engaged with the pay-off rotary gear 45 at a specific gear ratio, so that the take-up rotary gear 46 rotates in cooperation with the pay-off rotary gear 45 always at a specific rotation ratio. The rotation ratio, that is, the gear ratio of the both gears 45, 46 is set properly so that the coat film transfer tape T may be paid off and taken up properly in consideration of the winding diameter of the coat film transfer tape T on the pay-off reel 3 and take-up reel 4 as mentioned later.

In this relation, as shown in FIG. 3 to FIG. 6, the support main body 15 and the tape core 41 of the take-up reel 4 are provided with reverse rotation preventive mechanism 95 for preventing reverse rotation of the both reels 3, 4. The reverse rotation preventive mechanism 95 comprises, as shown in FIG. 4 and FIG. 6, a detent pawl 95*a* provided elastically deformably in the support base plate 20 of the support main body 15, and multiple reverse rotation preventive pawls 95*b*, 95*b*, . . . provided concentrically and annularly with the rotary shaft 32 on the outer side of the flange 41*b* of the tape core 41.

Accordingly, when the both reels 3, 4 are moved to rotate in the arrow direction, the detent pawl 95*a* rides over the reverse rotation preventive pawls 95*b*, 95*b*, . . . while deforming elastically, and allows the normal rotation. On the other hand, when the both reels 3, 4 are moved to rotate in the opposite direction of the arrow direction, the detent pawl 95*a* is engaged with any one of the reverse rotation preventive pawls 95*b*, 95*b*, . . . , and arrests the reverse rotation.

Moreover, by forming one more detent pawl 95*a* at a confronting position to the detent pawl 95*a* on the diameter line of the annular circle of disposing the reverse rotation preventive pawls 95*b*, 95*b*, . . . (see virtual line in FIG. 4), reverse rotation preventive action of better balance is achieved. The reverse rotation preventive mechanism 95 may be disposed, aside from the illustrated configuration, also between the case main body 5 and the take-up rotary gear 46 or pay-off rotary gear 45.

IV. Clutch mechanism 50

The clutch mechanism 50 of the embodiment is formed into a unit in the tape cartridge C together with the pay-off reel 3 and the pay-off rotary gear 45 of the tape interlock unit D, and is a replaceable consumable part, like the coat film transfer tape T. For this purpose, the specific structure of the clutch mechanism 50 is simple and inexpensive as explained below.

Figure 9:
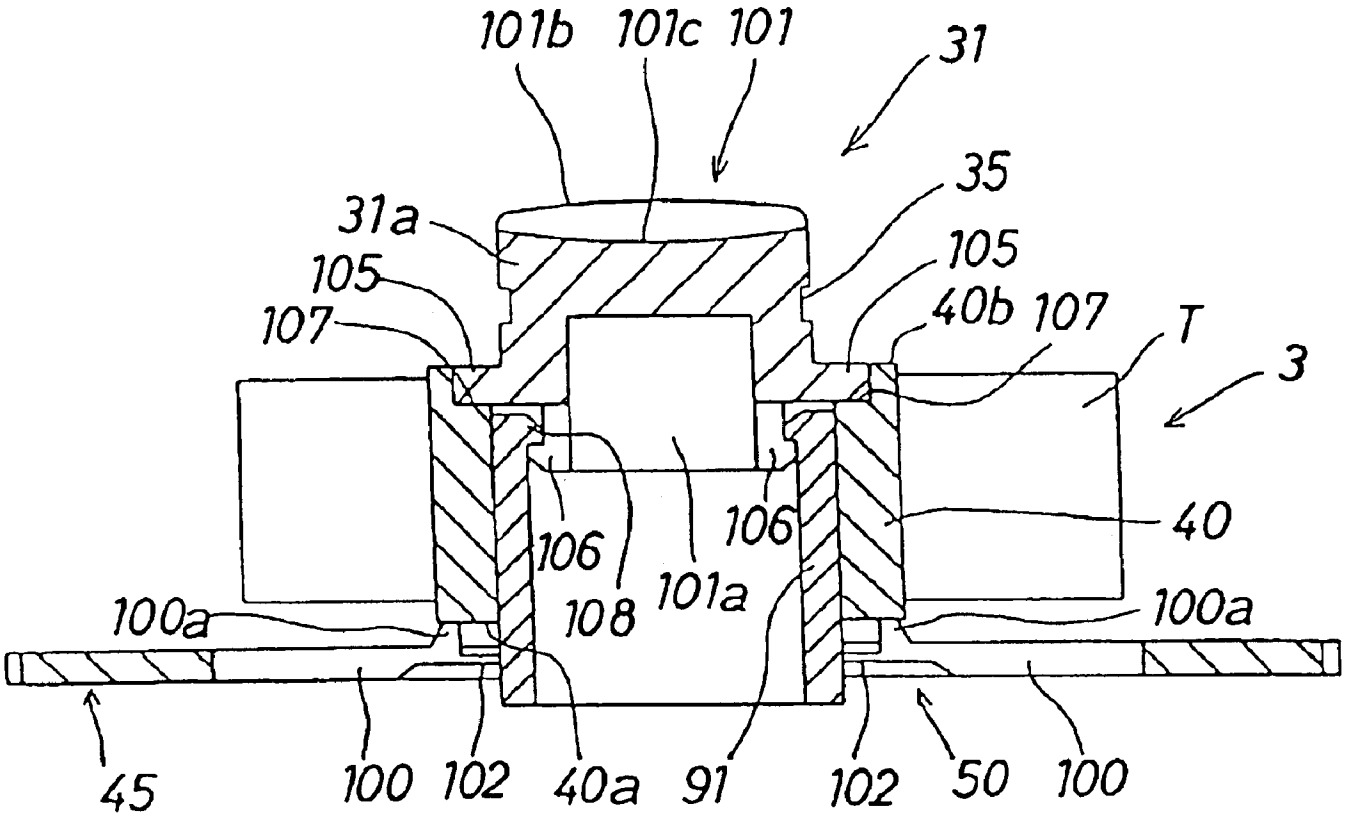
FIG. 9 is a front sectional view showing the pay-off reel side position of the tape cartridge of the eraser.
Figure 10:
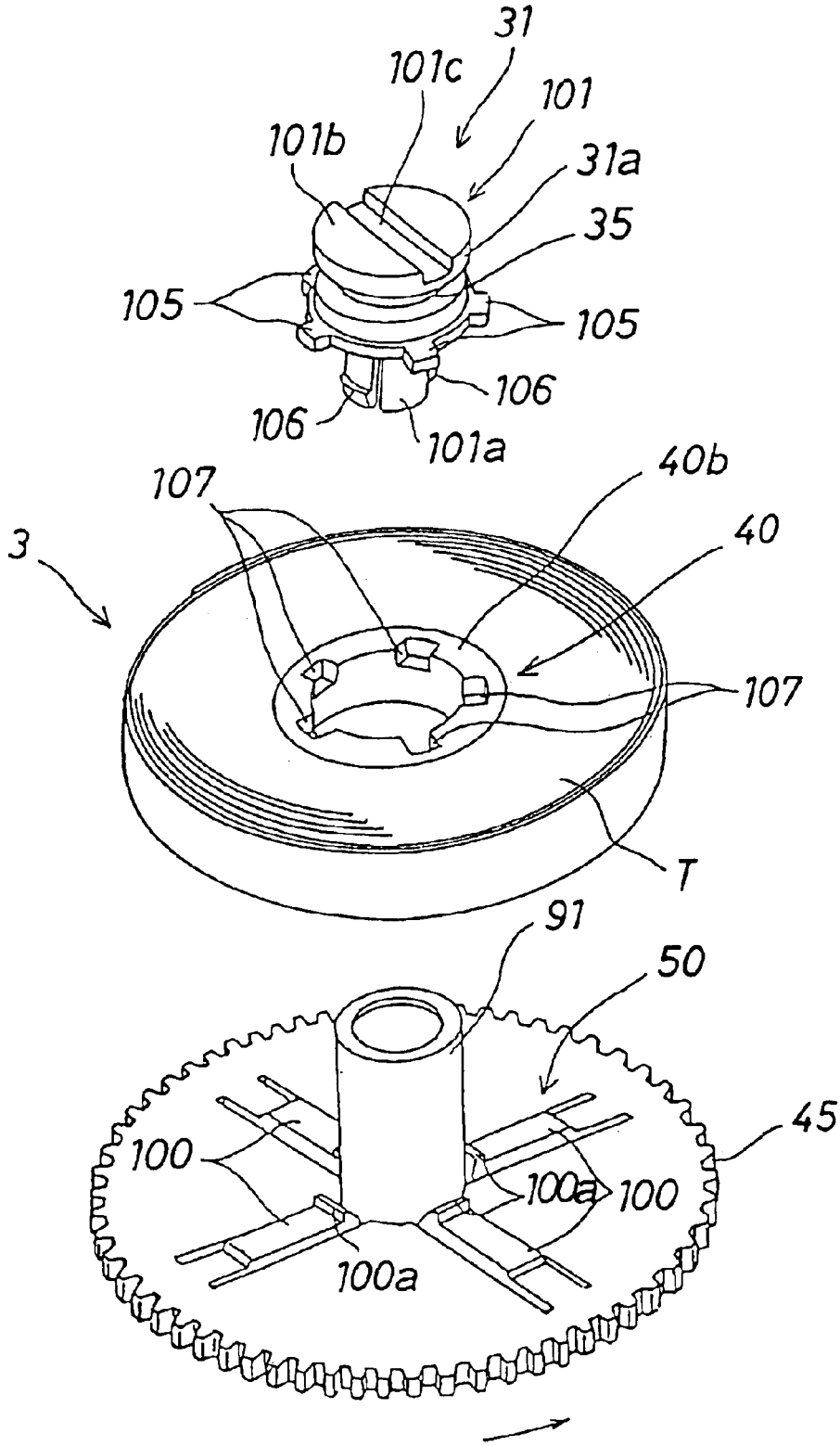
FIG. 10 is a perspective exploded view of the pay-off reel side position.
Figure 11A:
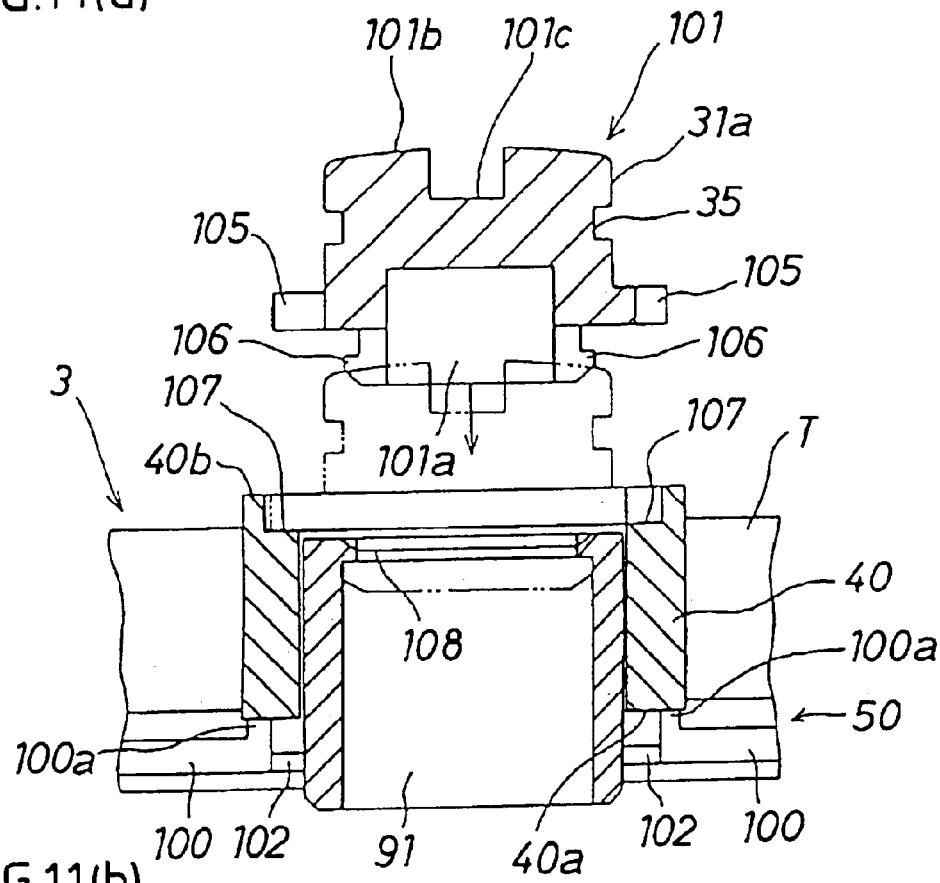
FIG. 11(*a*) is a front sectional view for explaining the assembling procedure of the pay-off reel side position with a rewind button disengaged from a rotary drive unit.
Figure 11B:
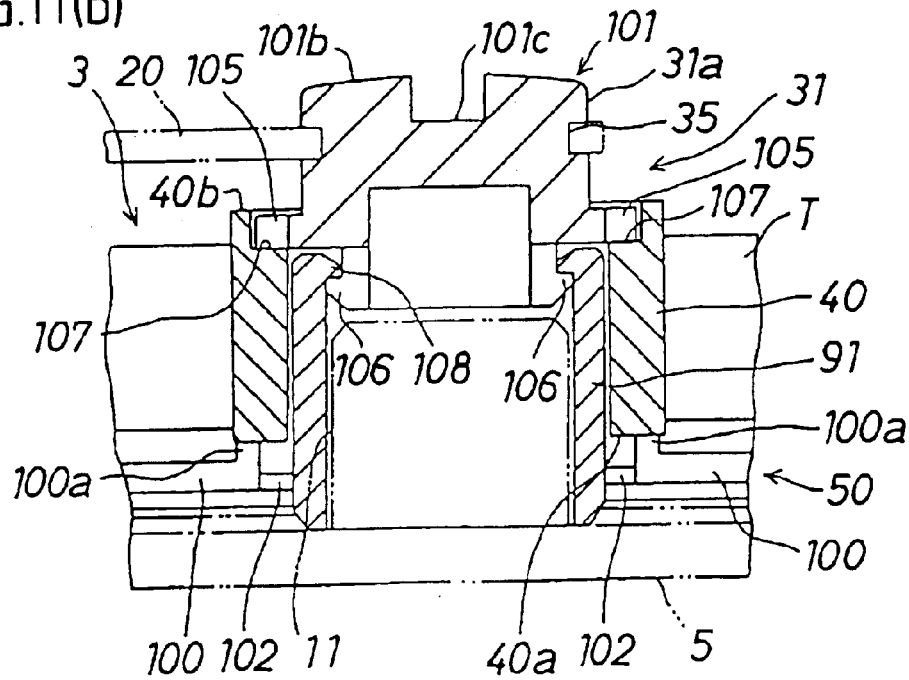

A specific structure of the clutch mechanism 50 is shown in FIG. 9 to FIG. 11(*b*), and is mainly composed of plural engaging protrusions 100, 100, . . . integrally formed in the pay-off rotary gear 45, and an engaging support member 101.

The engaging protrusions 100 function as frictional engaging members for composing the power transmitting means in the clutch mechanism 50, and are formed integrally as being extended inside the radial direction at plural positions (four positions in the drawing) in the circumferential direction of the pay-off rotary gear 45. The engaging protrusion 100 is elastically deformable in the axial direction from the base part at its outer circumferential side, and has an engaging portion 100*a* bulged upward at the leading end portion at its inner circumferential side. In the illustrated embodiment, the leading end portion at the inner circumferential side of the engaging protrusion 100 is integrally connected and supported to the rotary drive unit 91 by means of a thin-wall connection piece 102 for reinforcement.

The engaging portion 100*a* of the engaging protrusion 100 projects upward from the upper surface of the pay-off rotary gear 45 in ordinary state at a position opposite to the axial end 40*a* of the tape core 40, and has an engaging plane corresponding to the plane of the axial end 40*a*.

The engaging support member 101 is specifically a rewind button, and functions also as a constituent member of tape rewinding mechanism for eliminating the slack of coat film transfer tape T between the both reels 3, 4.

This rewind button 101 has an axial engaging portion 105 engaged with the axial end 40*b* of the tape core 40, and a detent pawl 106 engaged with the rotary drive unit 91.

The axial engaging portion 105 is an engaging bump projecting horizontally in the radial direction from the outer circumference of the rewind button 101, and functions also as a rotation engaging portion of the tape rewind mechanism, and five portions are provided at equal intervals in the circumferential direction in the illustrated example. In correspondence therewith, at the axial end 40*b* of the tape core 40, five engaging recesses 107 to be engaged with the axial engaging portions 105 are provided at equal intervals in the circumferential direction.

The detent pawl 106 is a vertical slit formed in a part of the mounting cylindrical portion 101*a* of the rewind button 101, and its leading end engaging portion is elastically deformable in the radial direction. In the illustrated example, a pair of detent pawls 106, 106 are provided oppositely on one diameter line of the mounting cylindrical portion 101*a*, and the leading end engaging portion of the detent pawl 106 is formed like a downward wedge.

In correspondence therewith, on the inner circumference of the rotary drive unit 91, there is an engaging flange 108 to be engaged with the detent pawl 106 in the axial direction. The inner diameter of the engaging flange 108 is set in a size enough to allow to insert the mounting cylindrical portion 101*a* of the rewind button 101, and fix by preventing the engaging leading end portion of the detent pawl 106 from slipping out.

Therefore, after inserting the tape core 40 of the pay-off reel 3 into the rotary drive unit 91, the rewind button 101 is inserted into the rotary drive unit 91 of the payoff rotary gear 45 so that the axial engaging portions 105, 105 may correspond to the engaging recesses 107, 107, . . . of the tape core 40. As a result, the detent pawls 106, 106 of the rewind button 101 are elastically deformed inside in the radial direction on the engaging flange 108 of the rotary drive unit 91, and pass in the axial direction, and, by elastic restoration, are engaged with the engaging flange 108 to prevent from slipping out (see FIG. 11(*a*) to FIG. 11(*b*)).

Accordingly, the tape core 40 is held and supported from both sides in the axial direction by means of the engaging protrusions 100, 100, . . . of the pay-off rotary gear 45 and the axial engaging portions 105, 105, . . . of the rewind button 101, and at the same time, by the axial engaging force of the rotary drive unit 91 and rewind button 101, the engaging protrusions 100, 100, . . . of the pay-off rotary gear 45 are frictionally engaged with the axial end 40*a* of the tape core 40 elastically in the rotating direction with a specified pressing force.

That is, in power transmission of the clutch mechanism 50, the frictional engaging force by the thrust load acting between the axial end 40*a* of the tape core 40 and engaging protrusions 100, 100, . . . of the pay-off rotary gear 45 is utilized, and this frictional engaging force is set to an optimum value by properly adjusting the engaging dimensional relation of the rotary drive unit 91 and the rewind button 101 in the axial direction.

More specifically, in consideration of the spring constant and elastic deformation amount of the engaging protrusions 100, 100, . . . of the pay-off rotary gear 45, the relative axial positional relation between the tape core 40 and pay-off rotary gear 45 by the axial engaging portion 105 of the rewind button 101 and the detent pawl 106 is properly adjusted, and the frictional engaging force of the engaging protrusions 100, 100, . . . and the axial end 40*a* of the tape core 40 is set to an optimum value.

When assembling the tape cartridge C, first, the composed units of pay-off reel 3, pay-off rotary gear 45, and rewind button 101 (see FIG. 10) are integrally assembled in the axial direction as shown in FIG. 9 and FIGS. 11(*a*) and 11 (b). In succession, the unit assemblies 3, 45, and 101, and the take-up reel 4 are mounted on the bearings 25, 26 of the support main body 20 in the procedure described above. Finally, the coat film transfer tape T forwarded from the pay-off reel 3 is set along the periphery of the coat film transfer head H as mentioned above, and the its leading end portion is connected to the take-up reel 4 so as to be wound up, and the tape cartridge C is completed.

The rewind button 101 is, as shown in FIG. 1, set opposite to the outside of the case 2 by way of the opening 14 formed in the case body 6 of the case 2, and is set flush with or lower than the surface or the gripping side 2*a* of the case 2 (see FIG. 2). At the outer end of the rewind button 101, that is, the outer surface 101*b*, a linear operation groove 101*c* is formed as a rotation operating unit for rewind rotating operation, and a coin or a plate operating member is detachably engaged with this operation groove 101*c*.

Referring now to FIG. 2 to FIG. 5, thus composed tape cartridge C is held by fingers, the pay-off rotary gear 45 is being engaged with the take-up rotary gear 46 mounted on the rotary support shaft 12 of the case main body 5, and the rotary shaft 91 of the pay-off rotary gear 45 and the tape core 41 of the take-up reel 4 are respectively engaged with the rotary support shaft 11 of the case main body 5 and the rotary shaft 46*a* of the take-up rotary gear 46 from upper side, and at the same time the coat film transfer head H is positioned and inserted into the insertion groove 10*a* which is the head holder of the case main body 5, so as to be set instantly.

At this time, the positioning engaging portions 38, 38, . . . of the support main body 15 are simultaneously engaged respectively with the positioning engaging portions 37, 37, . . . of the case main body 5. In the positioned state of the support main body 15, the support main body 15 cooperates with the rotary support shafts 11, 12, thereby rotating and supporting the pay-off reel 3 and take-up reel 4 at both sides.

On the other hand, by picking the support main body 15 by fingers and directly lifting to the upper side, the pay-off rotary gear 45, tape core 41, and coat film transfer head H can be detached easily and instantly from the rotary support shaft 11, rotary shaft 46*a* of the take-up rotary gear 46, and insertion groove 10*a*, respectively.

In this way, with the tape cartridge C being installed in the case main body 5, when the cap body 6 is put on the case main body 5 to prevent from moving and lock in the procedure mentioned above, the coat film transfer tool 1 is completed. In this case, the rewind button 101 is opposite to outside through the opening 14 of the cap body 6, and the coat film transfer head H projects outside through the head insertion part 10.

In this case, the coat film transfer head H can rotate about the head axial center in a rotating angle range of the operation lever 70 of the rotary operation unit 62 defined by the operation guide 72, and the coat film transfer head H can be held in an optimum state according to the purpose or the user's manner of holding.

That is, when correcting wrong letters by thus constituted coat film transfer tool 1, whether the user is right-handed or left-handed, as mentioned above, the operation lever 70 can be rotated and manipulated according to the purpose, and an optimum tape pressing and transferring position of the head main body 60 of the coat film transfer head H can be selected and set (for example, first defining position A shown in FIG. 8(*a*), second defining position B shown in FIG. 8(*b*), and third defining position C shown in FIG. 8(*c*)), and the gripping sides of the case 2 corresponding to the position are held by fingers (the standard gripping sides are face and back surfaces 2*a*, 2*b* of the case 2, and other sides of the case 2 may be also held depending on the purpose), so that various manners of use are realized as shown in FIG. 12(*a*) to FIG. 15(*b*).

In any manner of use, the gripping sides of the case 2 are held by fingers in the same manner as when holding a writing tool, and the leading end pressing portion 63 of the coat film transfer head H is pressed tightly to the start end of the correction area (transfer area) 110 on the sheet of paper to correct wrong letters, and the case 2 is moved directly along the sheet of paper, and stopped at the end (right end) of the correction area 110.

By this manipulation, the correction paint layer (white) 111 of the coat film transfer tape T in the pressing portion 63 of the coat film transfer head H is peeled off from the film base material, and is transferred and applied on the correction area 110. As a result, wrong letters are erased, and correct letters can be immediately written over.

On the other hand, the head main body 60 of the coat film transfer head H is freely rotatable about its axial center, while maintaining the standard tape pressing and transferring position set by the operation lever 70, and therefore not only the linear portion such as a line of characters, but also curves and other figures as shown in FIG. 12(*b*), FIG. 14(*b*), and FIG. 15(*b*) can be corrected neatly along the curvature.

Turning attention to the inside mechanism and operation of the coat film transfer tool 1, by such pressing manipulation of the coat film transfer head H, when the pulling force (arrow X direction in FIG. 4) applied on the coat film transfer tape T acts on the pay-off reel 3 as a rotary torque, the pay-off rotary gear 45 is put into rotation through the tape core 40 of the pay-off reel 3 and also the clutch mechanism 50. This rotating force causes to rotate the take-up rotary gear 46 and the take-up reel 4 integral therewith in the rotating direction in cooperation by means of the tape interlock unit D, thereby automatically winding up the used coat film transfer tape T'.

In this case, the rotation ratio (corresponding to the gear ratio of the tape interlock unit D) of the pay-off rotary gear 45 and take-up rotary gear 46 is always constant, but the ratio of the outer diameter of the coat film transfer tape T on the pay-off reel 3 and the outer diameter of the used coat film transfer tape T' on the take-up reel 4 is always changing and is not constant. That is, as the use is repeated, the outer diameter of the coat film transfer tape T on the pay-off reel 3 gradually decreases, while the outer diameter of the used coat film transfer tape T' on the take-up reel 4 increases to the contrary.

As a result, the take-up speed of the take-up reel 4 becomes gradually faster than the pay-off speed of the pay-off reel 3, and the synchronism of the two speeds is broken, and the rotary torque acting on the pay-off reel 3 gradually increases. Consequently, the rotary torque overcomes the frictional force of the clutch mechanism 50, and the tape core 40 slips and rotates on the pay-off rotary gear 45, and the difference in rotary torque between the two reels 3, 4 is canceled, and the pay-off speed is synchronized with the take-up speed, so that smooth running of the coat film transfer tape T is assured.

As mentioned above, since the power transmission in the clutch mechanism 50 makes use of the frictional force by the thrust load between the tape core 40 and the engaging protrusions 100, 100, . . . of the pay-off rotary gear 45, in the configuration of the clutch mechanism 50, by properly adjusting the dimensional relation of the mutual constituent members 3, 45, 91 in the thrust direction, the frictional force can be set at an optimum value.

Incidentally, if a slack of coat film transfer tape T occurs between the pay-off reel 3 and take-up reel 3 due to handling error by the user or the like, by manipulating the rewind button 101 in the rewind direction from outside of the case 2 (rotation in arrow Y direction in FIG. 4), the slack of the coat film transfer tape T can be eliminated.

In this case, the rotating force in the rewinding direction Y applied to the rewind button 101 is directly transmitted to the tape core 40 through the rotating engaging portions 105, 105, . . . serving also as axial engaging portions, and the tape core 40 rotates in the rewind direction Y. On the other hand, by the reverse rotation inhibiting force of the reverse rotation preventive mechanism 95 and the slip action of the clutch mechanism 50, the rotary gears 45, 46 of the tape interlock unit D and the tape core 41 of the take-up reel 4 are in stopped state. As a result, the slack of the coat film transfer tape T between the two reels 2, 3 is eliminated.

By the use of the coat film transfer tool 1, when the coat film transfer tape T wound on the pay-off reel 3 is completely wound up and collected on the take-up reel 4 as used tape T', the entire tape cartridge C is replaced with a new tape cartridge, and this replacement is done instantly.

That is, as mentioned earlier, in the tape cartridge C, the support main body 15 is composed to support rotatably the opposite side ends 31*a*, 32*a* of the rotary shafts 31, 32 of the both reels 3, 4 supported on the rotary support shafts 11, 12 of the case 2, and setting of the coat film transfer tape T on the coat film transfer head H has been already completed in the stage of the product.

Accordingly, the user, gripping the support main body 15, has only to cause the rotary shaft 31 (specifically the rotary shaft 91 of the pay-off rotary gear 45) and rotary shaft 32 (specifically the tape core 41) of the both reels 3, 4 to be engaged with the rotary support shaft 11 and rotary support shaft 12 (specifically the rotary shaft 46*a* of the take-up rotary gear 46) of the case 2 from the upper side, and put the tape cartridge C into the case 2 while positioning the coat film transfer head H at the leading end specified position of the case 2, that is, in the insertion groove 10*a* (this positioning is done easily by positioning means positions 37, 38, . . . ), so that the replacement is over.

In thus constituted coat film transfer tool 1, the support main body 15 of the tape cartridge C includes the support base plate 20 which rotatably supports the opposite-side ends 31*a*, 32*a* of the rotary shafts 31, 32 of the pay-off reel 3 and take-up reel 4 detachably and rotatably supported on the rotary support shafts 11, 12 of the case 2 of the coat film transfer tool 1, and this support base plate 20 has a flat plate skeletal structure having an outer contour corresponding to the inner contour of the case 2, and therefore as compared with the conventional plastic container, the rate of the amount of materials used for the support main body 15 in the entire device is substantially decreased.

Embodiment 2

Figure 16A:
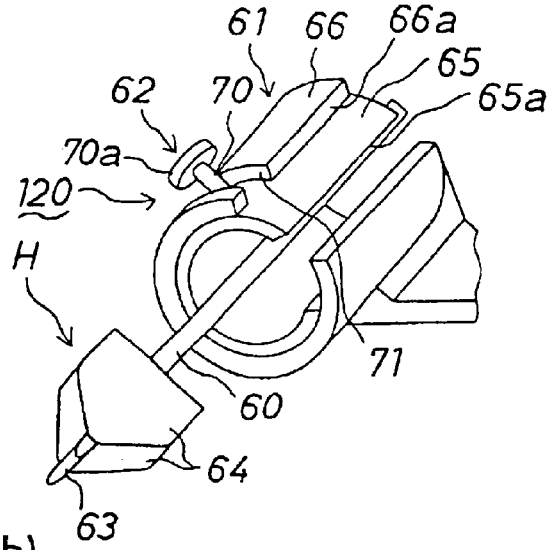
FIG. 16(*a*) is a perspective view showing the structure of a modified coat film transfer head of an eraser in embodiment 2 of the invention.
Figure 16B:
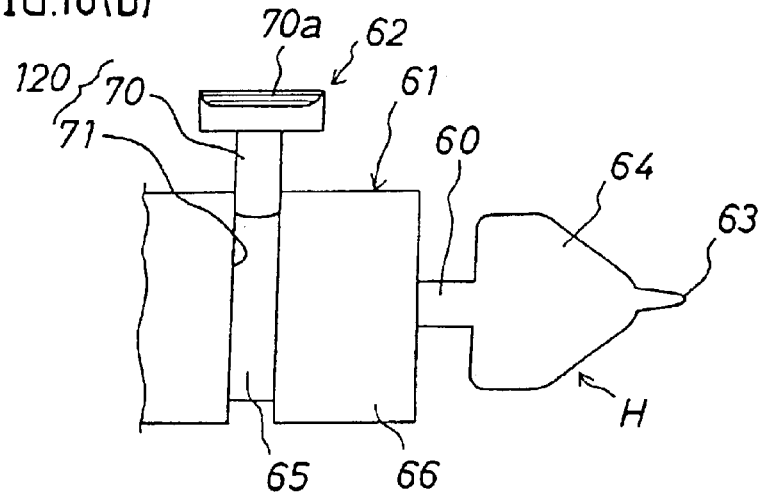
Figure 16C:
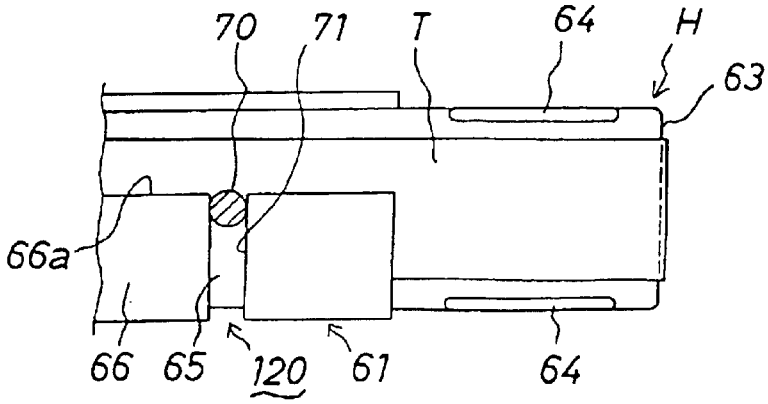

This embodiment is shown in FIGS. 16(*a*)–16(*c*), in which the structure of the coat film transfer head H is modified.

That is, the coat film transfer head H of the embodiment includes positioning means 120 for positioning and holding the head main body 60 steplessly around the axial center.

This positioning means 120 is specifically composed of the operation lever 70 provided in the supported portion 65 of the head holder 61, and the insertion part 71 provided in the bearing 66.

The insertion part 71 is set in the width dimension enough to be engaged with the operation lever 70 elastically to be held from its both sides, and functions as the positioning engaging portion of the operation lever 70.

In such configuration, the head main body 60 of the coat film transfer head H holds the tape pressing and transferring position freely selected and set by the operation lever 70, stably with a certain fixing force during use.

The other structure and action are same as in embodiment 1.

Embodiment 3

Figure 17A:
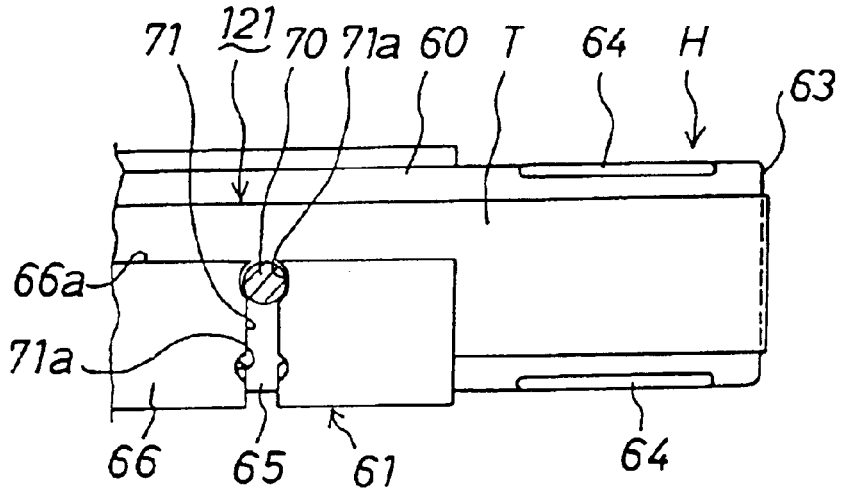
FIG. 17(*a*) is a top planar view showing the structure of another modified coat film transfer head of the eraser in embodiment 3 of the invention.
Figure 17B:
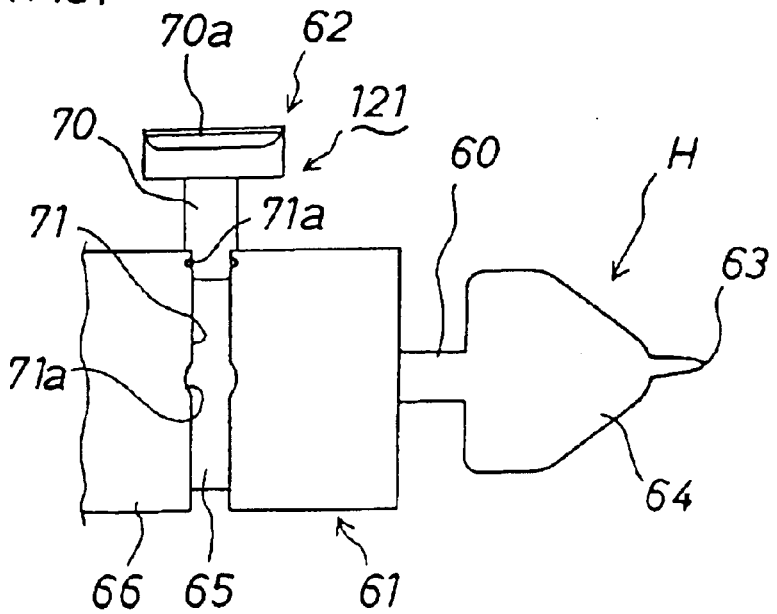

This embodiment is shown in FIGS. 17(*a*)–17(*b*), in which the structure of the coat film transfer head H is modified.

That is, the coat film transfer head H of the embodiment includes positioning means 121 for positioning and holding the head main body 60 at plural steps around the axial center.

This positioning means 121 is specifically composed of, same as in embodiment 2, the operation lever 70 provided in the supported portion 65, and the insertion part 71 provided in the bearing 66.

This insertion part 71 functioning as the positioning engaging portion is, same as in embodiment 2, set in the width dimension enough to be engaged with the operation lever 70 elastically to be held from its both sides, and further at the specified position in the longitudinal direction, positioning recesses 71*a*, 71*a*, . . . for positioning and accommodating the operation lever 70 are provided at specific intervals.

In such configuration, the head main body 60 of the coat film transfer head H holds the tape pressing and transferring position selected and set at steps by the operation lever 70, stably with a certain fixing force during use. The other structure and action are same as in embodiment 1.

Embodiment 4

Figure 18:
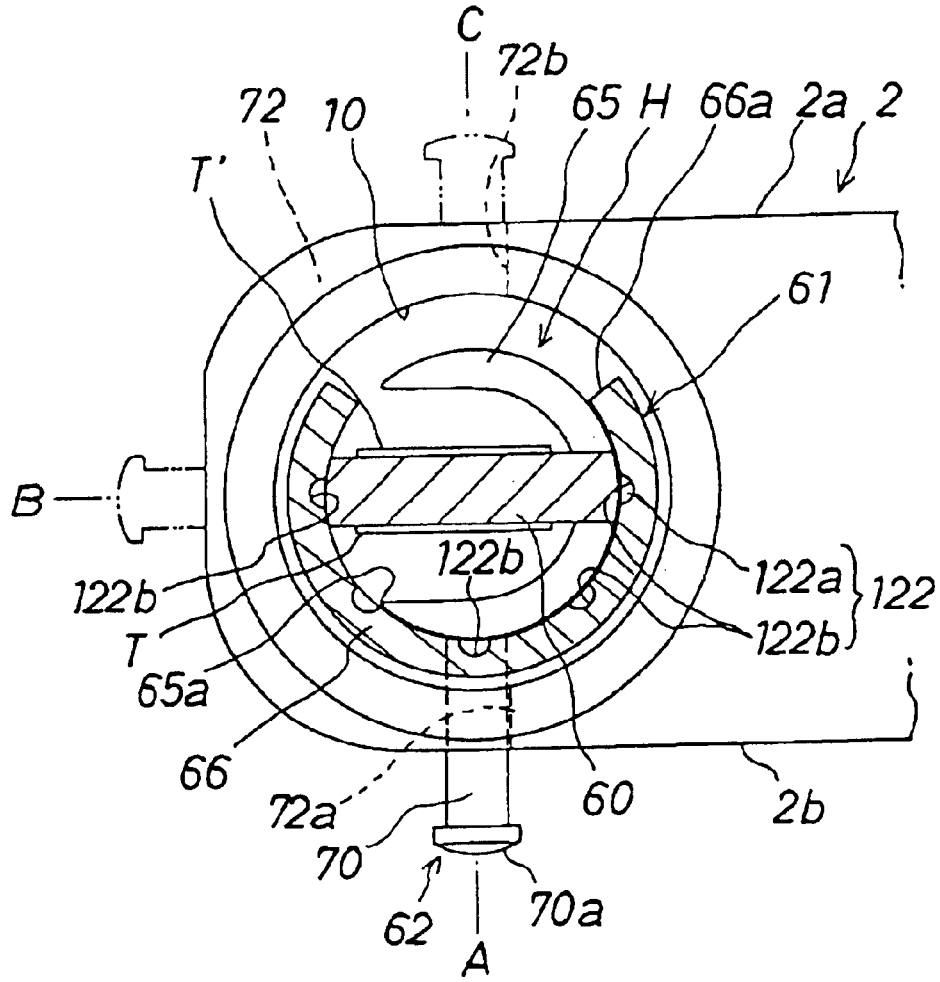
FIG. 18 is a perspective view showing the structure of a coat film transfer head of an eraser in embodiment 4 of the invention.
Figure 19A:
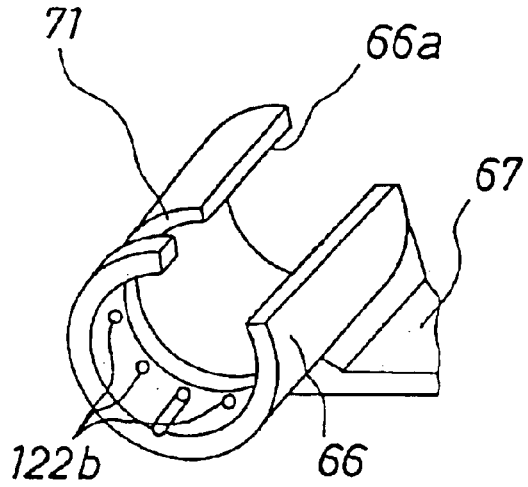
FIG. 19(*a*) is a perspective view showing a bearing of the coat film transfer head.
Figure 19B:
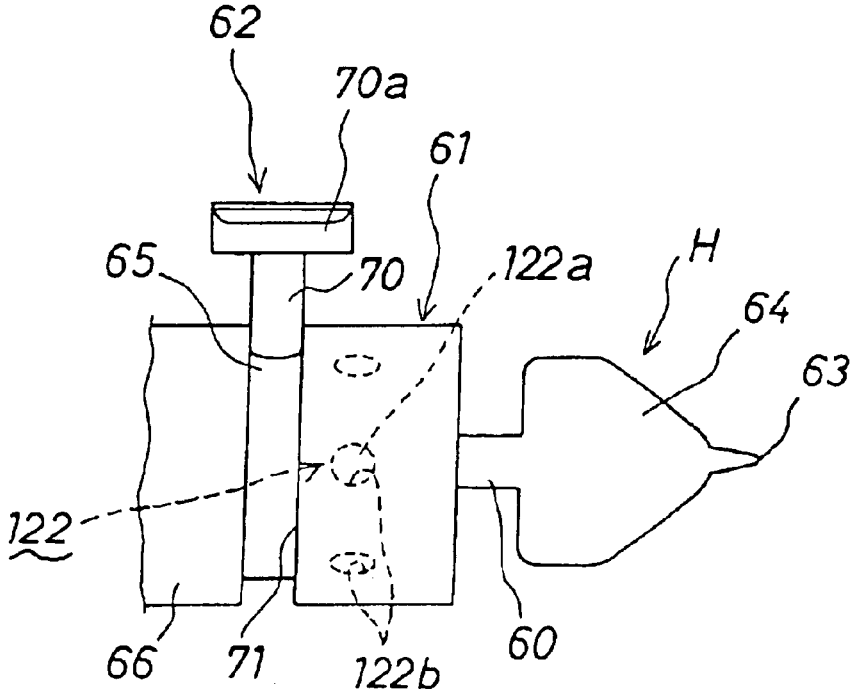

This embodiment is shown in FIG. 18 and FIGS. 19(*a*)–19(*b*), in which the structure of the coat film transfer head H is modified.

That is, the coat film transfer head H of the embodiment includes, same as in embodiment 3, positioning means 122 for positioning and holding the head main body 60 at plural steps around the axial center.

This positioning means 122 is composed of an engaging bump 122*a* provided on the cylindrical outer circumference of the supported portion 65, and engaging recesses 122*b*, 122*b*, . . . provided corresponding to the engaging bump 122*a* at specific intervals in the circumferential direction on the cylindrical inner circumference of the bearing 66, and the engaging bump 122*a* and any one of the engaging recesses 122*b*, 122*b*, . . . are elastically positioned and engaged with each other.

In such configuration, the head main body 60 of the coat film transfer head H, same as in embodiment 3, holds the tape pressing and transferring position selected and set at steps by the operation lever 70, stably with a certain fixing force during use.

Incidentally, the structural relation of the engaging bump 122*a* and the engaging recesses 122*b*, 122*b*, . . . may be reverse to the illustrated case.

The other structure and action are same as in embodiment 1.

Embodiment 5

Figure 20:
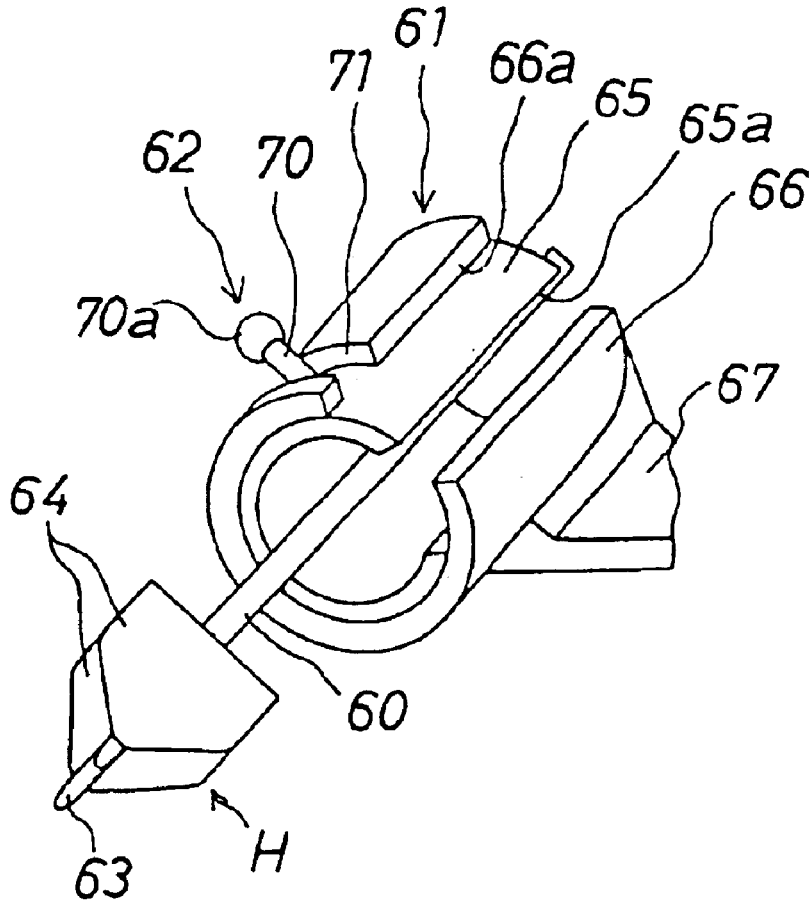
FIG. 20 is a perspective view showing the structure of a coat film transfer head of an eraser in embodiment 5 of the invention.

This embodiment is shown in FIG. 20, in which the shape of the operation lever 70 is slightly modified from the case of embodiment 1.

That is, in embodiment 1, the operation knob 70*a* of the operation lever 70 is a flat disk, but it is a spherical form in this embodiment. The other structure and action are same as in embodiment 1.

Embodiment 6.

Figure 21:
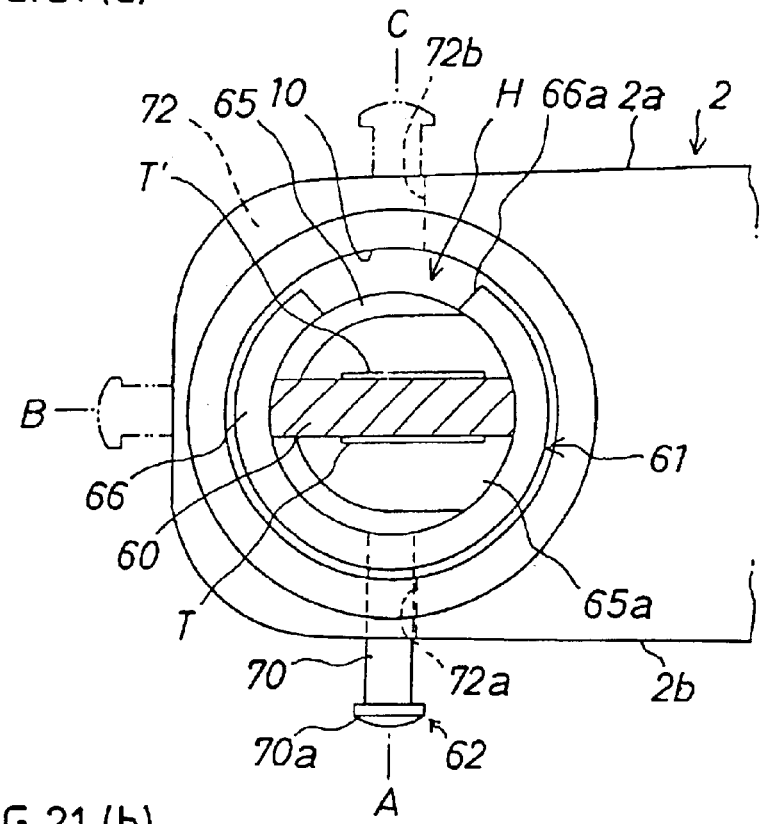
FIG. 21(*a*) is a partial sectional side view showing the structure of yet another coat film transfer head of the eraser in embodiment 6 of the invention with the operation lever in a vertical downward position.
Figure 21:
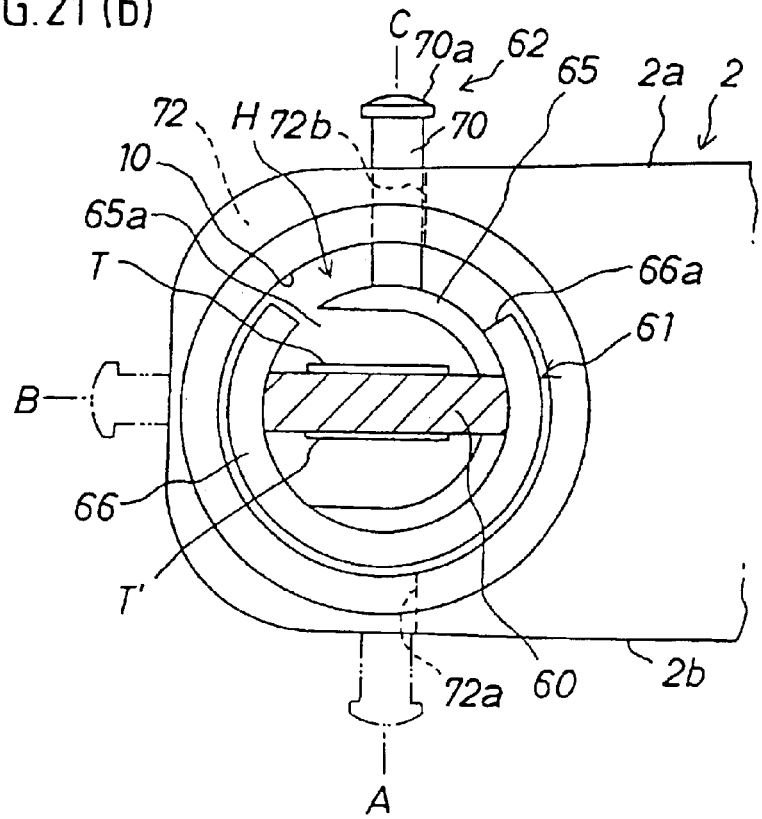

This embodiment is shown in FIGS. 21(*a*)–21 (b), in which the structure of the coat film transfer head H is slightly modified.

That is, the opening position of the setting opening 65*a* in the supported portion 65 is set at a position rotated by 180° from the case of embodiment 1.

In such configuration, in the rotation range defined by the operation lever 70 and operation guide 72 (range from FIG. 21(*a*) to (*b*)), the supported portion 65 and the bearing 66 are supported slidably and rotatably always with a cylindrical surface contacting relation.

The other structure and action are same as in embodiment 1.

Embodiment 7

Figure 22:
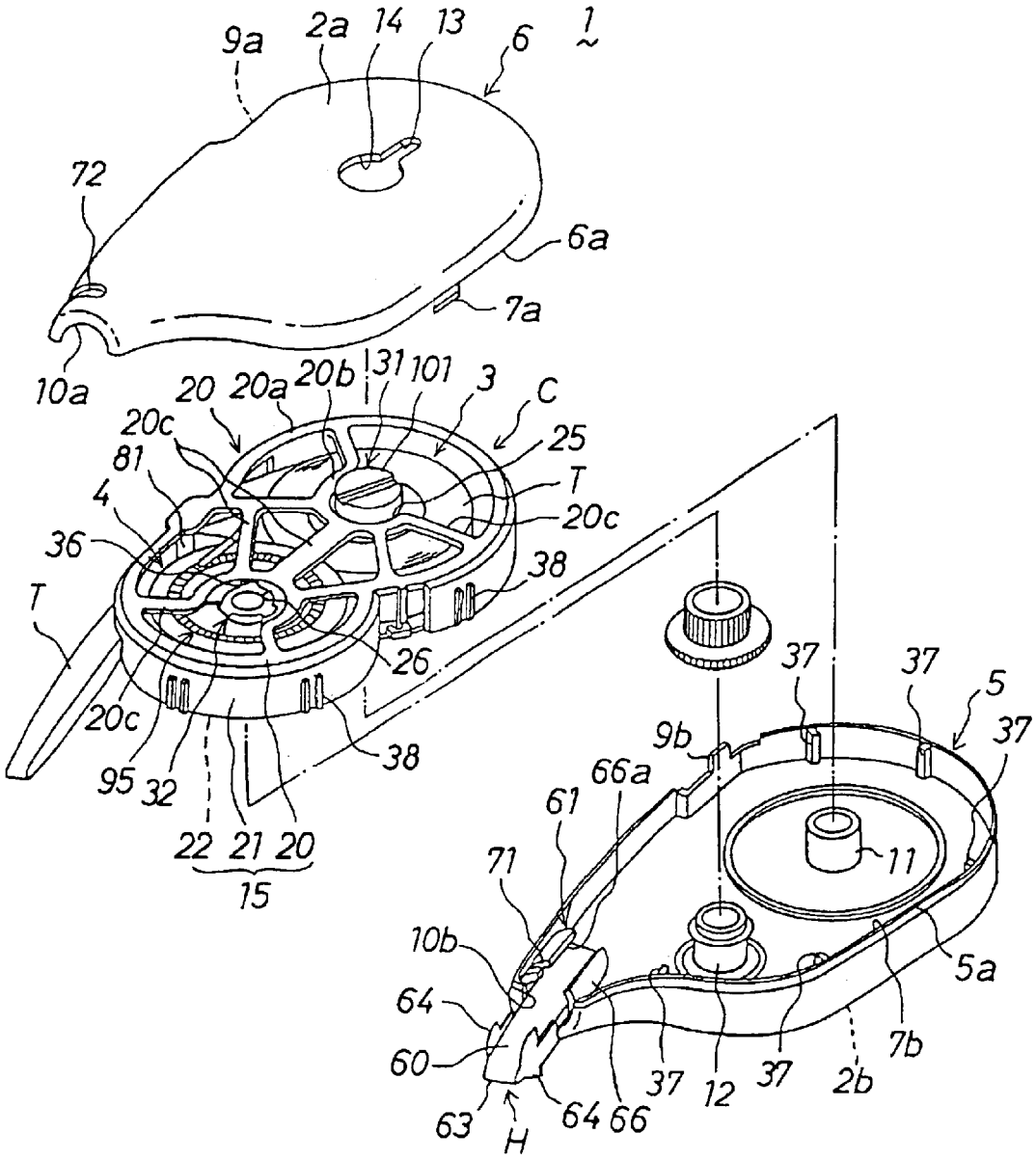
FIG. 22 is a perspective exploded view of an eraser in embodiment 7 of the invention.
Figure 23:
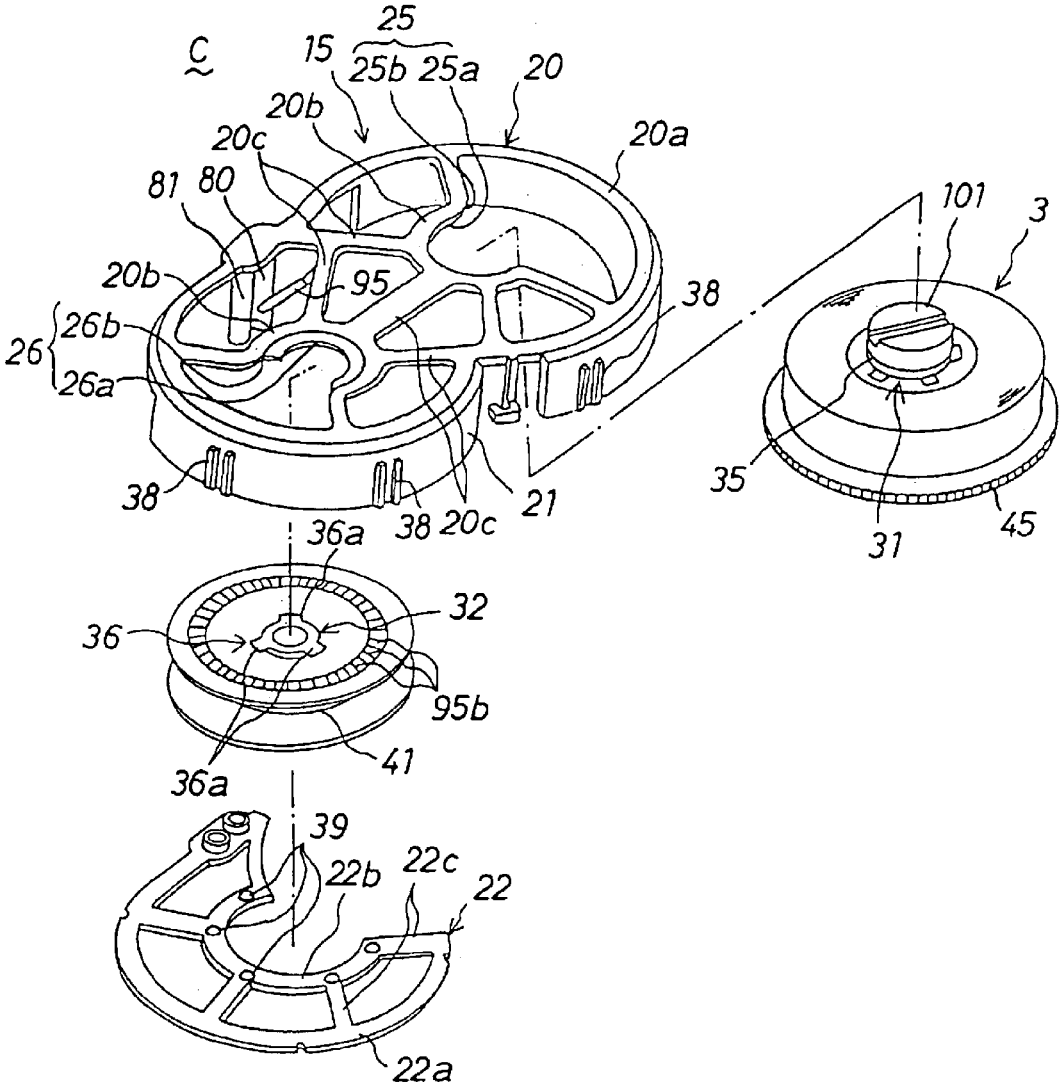
FIG. 23 is a perspective exploded view of a tape cartridge of the eraser.
Figure 24:
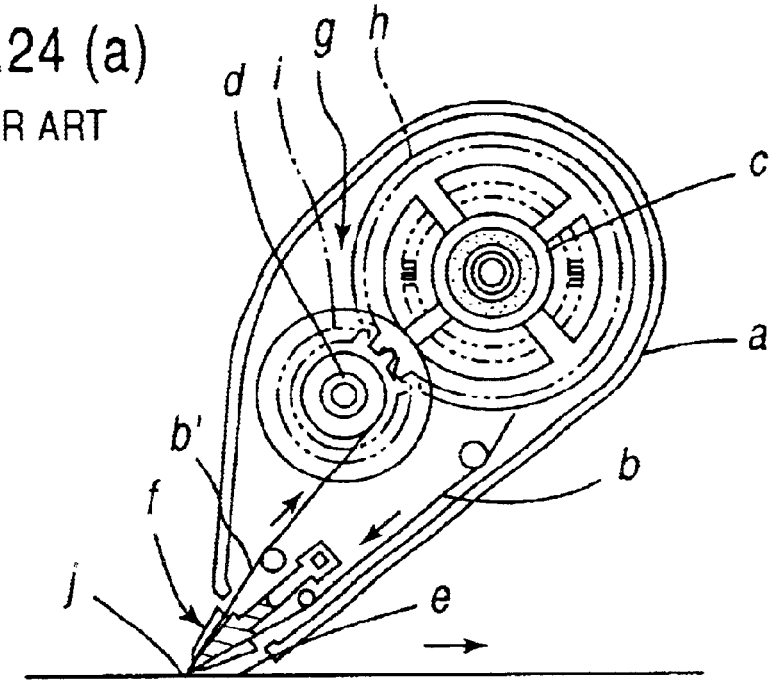
FIG.24 (a) PRIOR ART
FIG. 24(*a*) is a partially cut-away front view of internal structure of a conventional eraser in vertical pulling use structure.
Figure 24:
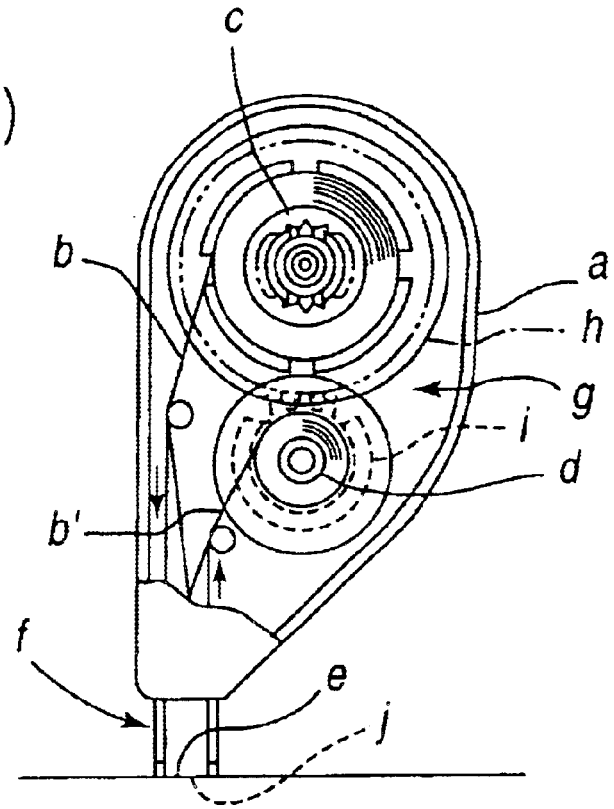
FIG.24 (b) PRIOR ART

This embodiment is shown in FIG. 22 and FIG. 23, in which the mounting position of the coat film transfer head H is modified.

That is, in this embodiment, the coat film transfer head H is attached to the leading end portion of the case 2. The structure of the coat film transfer head H is identical with that in embodiment 1, except for the mounting position.

The other structure and action are same as in embodiment 1.

The foregoing embodiments 1 to 7 are preferred embodiments of the invention, and the invention is not limited to them alone, but may be changed and modified in various forms within the specified range. For example, the following changes are possible.

(1) The constituent parts of the tape cartridge C, for example, the support main body 15, particularly, its support base plate 20, and the structure of the coat film transfer head H are not limited to the illustrated embodiments alone as far as the specified purpose is achieved.

(2) In the illustrated embodiments, the clutch mechanism 50 is disposed at the pay-off reel 3 side, but it may be also disposed at the take-up reel side 4 depending on the purpose, or may be disposed at both reels 3, 4. Thus, when the clutch mechanism is provided at the both reels 3, 4, in the rewinding operation by the tape rewind mechanism, application of excessive tension on the coat film transfer tape T can be effectively prevented.

(3) Instead of the correction paint layer of the coat film transfer tape T in the illustrated coat film transfer tool, by using a paint layer presenting a clear fluorescent color, the position coated with this paint layer is emphasized visually, so that it can be used as a so-called marker coat film transfer tool.

(4) As the coat film transfer tape T, by using film base material of which one side is coated with an adhesive through a peeling layer, the coat film transfer tool may be used as a gluing tool for transferring only the adhesive layer on the paper.

(5) All illustrated embodiments relate to the refill type coat film transfer tool capable of replacing the coat film transfer tape, but the invention may be also applied to the disposable type coat film transfer type not allowing to replace the coat film transfer tape.

As described in detail herein, according to the invention, the coat film transfer head device comprises a head main body for pressing and transferring a coat film transfer tape, a head holder for supporting the head main body rotatably about its axial center, and a rotation operation unit for positioning the head main body in the rotating direction, this rotating operation unit functions also as the head position indicating unit for indicating the tape pressing and transferring position of the head main body, so that the following excellent effects are brought about.

That is, the head main body, by manipulating the rotating operation unit, can properly select and set its position in the rotating direction within a specified range, and an optimum tape pressing and transferring position can be taken depending on the application or user's manner of holding. It also includes a concept that the coat film transfer tool of the invention, if originally designed for use by a right-handed user in the head basic structure, can be held and used by a left-handed user naturally in an optimum head position.

The rotating operation unit also functions as a head position indicating unit for indicating the tape pressing and transferring position of the head main body, so that the user can check the tape pressing and transferring position directly and visually.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A coat film transfer head device adapted for use with and disposed at a leading end portion of a coat film transfer tool for pressing a coat film transfer tape onto an object of transfer, comprising:

a head main body for pressing and transferring the coat film transfer tape, a head holder for supporting the head main body rotatably about its axial center, and a rotating operation unit for operating said head main body in a rotating direction, wherein the rotating operation unit includes an operation lever integrally formed with the head main body, and the operation lever serves also as a head position indicating unit for indicating the tape pressing and transferring position of the head main body.

2. The coat film transfer head device of claim 1, wherein the operation lever of the rotating operating unit is related to the tape pressing and transferring position of said head main body, and the operation lever projects to the outside of the case through an operation guide in a slit form penetrating through the case of the coat film transfer tool.

3. The coat film transfer head device of claim 2, wherein said operation guide in a slit form defines the operating range in the rotating direction of the operation level, and controls the tape pressing and transferring position of the head main body.

4. The coat film transfer head device of any one of claims 1 to 3, wherein said head holder includes a cylindrical supported portion provided concentrically and integrally with the head main body, and a cylindrical bearing provided at the device main body side for supporting the supported portion slidably and rotatably.

5. The coat film transfer head device of claim 4, wherein said supported portion is formed in an arc section having a setting opening for coat film transfer tape to the head main body in part.

6. The coat film transfer head device of claim 1, further comprising:

positioning means for positioning and holding the head main body steplessly around its axial center.

7. A coat film transfer head device adapted for use with and disposed at a leading end portion of a coat film transfer tool for pressing a coat film transfer tape onto the object of transfer, comprising:

a head main body for pressing and transferring the coat film transfer tape, a head holder for supporting the head main body rotatably about its axial center, and a rotating operation unit for positioning said head main body in the rotating direction, and positioning means for positioning and holding the head main body steplessly around its axial center, wherein the positioning means comprises an operation lever provided in a cylindrical supported portion, and a positioning engaging portion in a slit form provided in a cylindrical bearing opposite to an operation guide in a slit form, to be engaged with the operation lever elastically as being held at both sides, the rotating operation unit serves also as a head position indicating unit for indicating the tape pressing and transferring position of the head main body and the head holder includes the supported portion provided concentrically and integrally with the head main body, and the cylindrical bearing provided at the device main body side for supporting the supported portion slidably and rotatably.

8. The coat film transfer head device of claim 1, further comprising:

positioning means for positioning and holding the head main body at plural steps around its axial center.

9. A coat film transfer head device adapted for use with and disposed at a leading end portion of a coat film transfer tool for pressing a coat film transfer tape onto the object of transfer, comprising:

a head main body for pressing and transferring the coat film transfer tape, a head holder for supporting the head main body rotatably about its axial center, and a rotating operation unit for positioning said head main body in the rotating direction, positioning means for positioning and holding the head main body at plural steps around its axial center, wherein the positioning means comprises an operation lever provided in a cylindrical supported portion, and a positioning engaging portion in a slit form provided in the cylindrical bearing opposite to an operation guide in a slit form, and the positioning engaging portion has a width enough to be engaged with the operation lever elastically as being held at both sides, and also includes a positioning recess for positioning the operation lever at a specified position in its longitudinal direction, the rotating operation unit serves also as a head position indicating unit for indicating the tape pressing and transferring position of the head main body and the head holder includes the supported portion provided concentrically and integrally with the head main body, and the cylindrical bearing provided at the device main body side for supporting the supported portion slidably and rotatably.

10. A coat film transfer head device adapted for use with and disposed at a leading end portion of a coat film transfer tool for pressing a coat film transfer tape onto the object of transfer, comprising:

a head main body for pressing and transferring the coat film transfer tape, a head holder for supporting the head main body rotatably about its axial center, and a rotating operation unit for positioning said head main body in the rotating direction, positioning means for positioning means comprises an engaging bump provided on a cylindrical outer circumference of a cylindrical supported portion or a cylindrical inner circumference of a cylindrical bearing, and engaging recesses provided at specific intervals in the circumferential direction on the cylindrical inner circumference of the cylindrical bearing or the cylindrical outer circumference of the supported portion, and the engaging bump and engaging recess are elastically positioned and engaged, the rotating operation unit serves also as a head position indicating unit for indicating the tape pressing and transferring position of the head main body and the head holder includes the supported portion provided concentrically and integrally with the head main body, and the cylindrical bearing provided at the device main body side for supporting the supported portion slidably and rotatably.

11. A refill type coat film transfer tool operative for use with a replaceable coat film transfer tape, wherein a tape cartridge containing a rotatable payoff reel on which the coat film transfer tape is wound, and a rotatable take-up reel for collecting the used coat film transfer tape is detachably provided in a case which is held by one hand, coat film transfer head means for pressing the coat film transfer tape onto the object of transfer is attached to the leading end portion of said tape cartridge, the coat film transfer head means comprises a head main body for pressing and transferring the coat film transfer tape, a head holder for supporting the head main body rotatably about its axial center, and a rotating operation unit for operating the head main body in the rotating direction, and the rotating operation unit includes an operation lever integrally formed with the head main body, and the operation lever functions also as a head position indicating unit for indicating the tape pressing and transferring position of the head main body.

12. A disposable coat film transfer tool using a one-time coat film transfer tape, wherein a pay-off reel on which a coat film transfer tape is wound, and a take-up reel for collecting the used coat film transfer tape are provided in a case which is held by one hand, coat film transfer head means for pressing the coat film transfer tape onto the object of transfer is attached to the leading end portion of said case, the coat film transfer head means comprises a head main body for pressing and transferring the coat film transfer tape, a head holder for supporting the head main body rotatably about its axial center, and a rotating operation unit for operating the head main body in the rotating direction, and the rotating operation unit includes an operation lever integrally formed with the head main body, and the operation lever functions also as a head position indicating unit for indicating the tape pressing and transferring position of the head main body.

* * * * *